US006632597B2

(12) United States Patent
Takizawa

(10) Patent No.: US 6,632,597 B2
(45) Date of Patent: Oct. 14, 2003

(54) METHINE DYE AND SILVER HALIDE PHOTOGRAPHIC MATERIAL CONTAINING THE SAME

(75) Inventor: Hiroo Takizawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/943,354

(22) Filed: Aug. 31, 2001

(65) Prior Publication Data

US 2002/0155400 A1 Oct. 24, 2002

(30) Foreign Application Priority Data

Sep. 5, 2000 (JP) ..... 2000-268923
Sep. 5, 2000 (JP) ..... 2000-268924

(51) Int. Cl.[7] ..... G03C 1/005; G03C 1/494

(52) U.S. Cl. ..... 430/574; 430/570; 430/576; 430/581; 430/583

(58) Field of Search ..... 430/570, 574, 430/576, 581, 583

(56) References Cited

U.S. PATENT DOCUMENTS 3,976,493 A * 8/1976 Borror et al. ..... 430/579
5,032,500 A * 7/1991 Ikeda et al. ..... 430/570
5,871,897 A * 2/1999 Katoh ..... 430/581

FOREIGN PATENT DOCUMENTS

EP 0 877 700 A1 6/1998

* cited by examiner

*Primary Examiner*—Geraldine Letscher
(74) *Attorney, Agent, or Firm*—Sughrue Mion, PLLC

(57) ABSTRACT

A compound represented by the following formula (1) and a silver halide photographic material containing the compound:

(1)

wherein Dye 1 represents a first chromophore; Dye 2 represents a second chromophore; $L_1$ represents a linking chain; $R_1$ represents a dissociable group having pKa of 5 or less; $m_1$ represents an integer of from 1 to 5; $m_2$ represents an integer of from 1 to 5; and $m_3$ represents an integer of from 1 to 4.

13 Claims, No Drawings

METHINE DYE AND SILVER HALIDE PHOTOGRAPHIC MATERIAL CONTAINING THE SAME

FIELD OF THE INVENTION

The present invention relates to a novel methine dye compound, in particular a linked type methine dye compound in which two chromophores are linked, and a silver halide photographic material containing the same.

BACKGROUND OF THE INVENTION

The methine compound has so far been used in a silver halide photographic material as a spectral sensitizing dye. Techniques which have been well known as the techniques for improving the light absorptivity of silver halide grains are shown below. For improving the light absorptivity per one grain, it is necessary to increase the adsorption density of a sensitizing dye onto a silver halide grain, but generally used spectral sensitizing dyes are adsorbed onto the monomolecular layer at almost the closest packing density and cannot be adsorbed beyond that.

Some techniques have been suggested for solving this problem. For example, P. B. Gilman, Jr., et al. made a cationic dye adsorb onto the first layer and further an anionic dye onto the second layer as described in *Photographic Science and Engineering,* Vol. 20, No. 3, p. 97 (1976). G. B. Bird, et al. made a plurality of dyes adsorb onto silver halide particles by multilayer adsorption and effected sensitization due to Forster type excitation energy transfer as disclosed in U.S. Pat. No. 3,622,316.

Sugimoto et al. performed spectral sensitization due to energy transfer from a luminescent dye in JP-A-63-138341 and JP-A-64-84244 (the term "JP-A" as used herein means an "unexamined published Japanese patent application").

These are all trials to intend to make a dye of the amount more than a saturation adsorption amount adsorb onto a silver halide grain, but any of these is not so effective to improve sensitivity. On the contrary, there are problems of the increase of intrinsic desensitization.

On the other hand, two-component linked dyes comprising two or more non-conjugated chromophores of dyes linked by covalent bonding are disclosed in U.S. Pat. Nos. 2,393,351, 2,425,772, 2,518,732,2,521,944, 2,592,196 and European Patent 565083. However, the objects of these patents were not to intend to increase a light absorptivity. As techniques which positively aimed at improving a light absorptivity, G. B. Bird et al. contrived sensitization by the contribution of energy transfer by the adsorption of linked type sensitizing dye molecules having a plurality of cyanine chromophores to thereby increase a light absorptivity as disclosed in U.S. Pat. Nos. 3,622,317 and 3,976,493, however, conspicuous sensitivity improvement has not been obtained as yet.

Ukai et al. suggest in JP-A-64-91134 to bond at least one substantially non-adsorptive dye containing at least two sulfo groups or carboxyl groups to a spectral sensitizing dye which is adsorbable onto a silver halide.

Further, Bishwakalma et al. performed spectral sensitization by using two-component linked dyes comprising a cyanine dye adsorptive onto silver halide and a non-adsorptive oxonol dye as disclosed in JP-A-6-27578, and Parton et al. by using two-component linked dyes comprising an adsorptive cyanine dye and a non-adsorptive merocyanine dye by a specific linking group as disclosed in EP-A-887700, but it cannot be said that sufficient improvement of sensitization by the contribution of energy transfer has been attained.

Thus, sufficient higher sensitization has not been achieved by any methods of the above patents and literature as yet and further technical development is required.

SUMMARY OF THE INVENTION

Accordingly, an object of the present invention is to provide a novel methine linked dye and a high sensitivity silver halide photographic material containing the same.

The above object of the present invention has been achieved by the following means.

(1) A silver halide photographic material comprising a support having provided thereon at least one light-sensitive silver halide emulsion layer, wherein the emulsion layer contains a compound represented by the following formula (1):

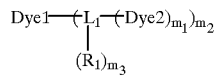

$$\text{Dye1}-(L_1-(\text{Dye2})_{m_1})_{m_2} \quad (1)$$
$$\quad\quad |$$
$$\quad (R_1)_{m_3}$$

wherein Dye 1 represents a first chromophore; Dye 2 represents a second chromophore; $L_1$ represents a linking chain; $R_1$ represents a dissociable group having pKa of 5 or less; $m_1$ represents an integer of from 1 to 5; $m_2$ represents an integer of from 1 to 5; and $m_3$ represents an integer of from 1 to 4.

(2) The silver halide photographic material as described in the above item (1), wherein $R_1$ in formula (1) represents —$SO_3M$, —$OSO_3M$, —$PO_3M_2$, —$OPO_3M_2$ or —COOM, and M represents a proton or a cation.

(3) The silver halide photographic material as described in the above item (1) or (2), wherein $L_1$ in formula (1) is represented by $-G_1-(A_1-G_2-)_{t1}-$; $G_1$ and $G_2$ each represents an alkylene group or an alkenylene group; $A_1$ represents —O—, —S—, —$SO_2$—, —$NR_2$—, —COO—, —$CONR_3$—, or —$SO_2NR_4$— regardless of the groups of both sides; $R_2$, $R_3$ and $R_4$ each represents a hydrogen atom, an alkyl group, an alkenyl group, an aryl group or a heterocyclic group; $t_1$ represents an integer of from 1 to 10; and $R_1$ may substitute on any of $G_1$, $G_2$, $R_2$, $R_3$ and $R_4$.

(4) The silver halide photographic material as described in the above item (1), (2) or (3), wherein in the compound represented by formula (1), Dye 1 and Dye 2 each represents a cyanine chromophore, a merocyanine chromophore or an oxonol chromophore.

(5) The silver halide photographic material as described in any of the above items (1) to (4), wherein in the compound represented by formula (1), Dye 1 and Dye 2 each represents a cyanine chromophore or a merocyanine chromophore.

(6) The silver halide photographic material as described in any of the above items (1) to (5), wherein in the compound represented by formula (1), Dye 1 represents a cyanine chromophore and Dye 2 represents a cyanine chromophore or a merocyanine chromophore.

(7) The silver halide photographic material as described in any of the above items (1) to (6), wherein in the compound represented by formula (1), Dye 1 and Dye 2 each represents a cyanine chromophore.

(8) The silver halide photographic material as described in any of the above items (1) to (7), wherein the compound represented by formula (1) is represented by the following formula (2):

(2)

(Dye2)

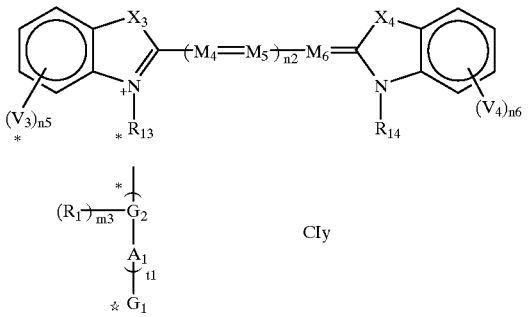

CIy (Dye1)

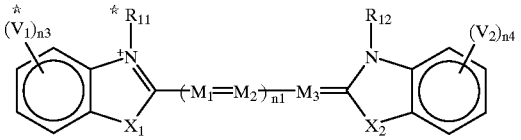

wherein $G_1$, $G_2$, $A_1$ and $t_1$ have the same meaning as described in the above item (3); $R_1$ represents —$SO_3M$, —$OSO_3M$, —$PO_3M_2$, —$OPO_3M_2$ or —COOM; M represents a proton or a cation; $m_3$ represents an integer of from 1 to 4; $R_1$ may substitute on any of $G_1$, $G_2$ and $A_1$; $X_1$, $X_2$, $X_3$ and $X_4$ each represents —O—, —S—, —$NR_5$— or —$CR_6R_7$—; $R_5$, $R_6$ and $R_7$ each represents a hydrogen atom, an alkyl group, an alkenyl group, an aryl group or a heterocyclic group; $R_{11}$, $R_{12}$, $R_{13}$ and $R_{14}$ each represents a hydrogen atom, an alkyl group, an alkenyl group, an aryl group or a heterocyclic group; $M_1$, $M_2$, $M_3$, $M_4$, $M_5$ and $M_6$ each represents a methine group; $n_1$ and $n_2$ each represents an integer of from 0 to 3; $V_1$, $V_2$, $V_3$ and $V_4$ each represents a substituent; $n_3$, $n_4$, $n_5$ and $n_6$ each represents an integer of from 0 to 4, when $n_3$, $n_4$, $n_5$ and n6 each represents 2 or more, $V_1$, $V_2$, $V_3$ and $V_4$ may be the same or different, and they may be linked to each other to form a ring; CI represents an ion to neutralize electric charge; y represents a number necessary to neutralize electric charge; and $G_1$ is linked to Dye 1 via $R_{11}$ or $V_1$, and $G_2$ is linked to Dye 2 via $R_{13}$ or $V_3$.

(9) The silver halide photographic material as described in the above item (8), wherein in the compound represented by formula (2), $X_1$ and $X_2$ each represents —O— or —S—.

(10) The silver halide photographic material as described in the above item (8) or (9), wherein in the compound represented by formula (2), $G_1$ is linked to $R_{11}$ and $G_2$ is linked to $R_{13}$.

(11) The silver halide photographic material as described in any of the above items (1) to (10), wherein in the compound represented by formula (1) or (2), the adsorptivity to a silver halide grain satisfies the following relationship:

$$\text{Dye 1} \geqq \text{Dye 2} > L_1\text{-}(R_1)_{m3}$$

(12) The silver halide photographic material as described in any of the above items (1) to (11), wherein Dye 1 and Dye 2 in the compound represented by formula (1) or (2) have the same structure.

(13) The silver halide photographic material as described in any of the above items (1) to (12), wherein in the compound represented by formula (1) or (2), only one chromophore of Dye 1 or Dye 2 is adsorbed onto a silver halide grain, and when the chromophore not adsorbed onto a silver halide grain is excited by light, the chromophore not adsorbed onto a silver halide grain is transferred to the chromophore adsorbed onto a silver halide grain by electron transfer or energy transfer.

(14) The silver halide photographic material as described in any of the above items (1) to (13), wherein in the compound represented by formula (1) or (2) contained in the silver halide photographic emulsion, only one of Dye 1 or Dye 2 is adsorbed onto a silver halide grain and forms J association, and the chromophore which is not adsorbed onto a silver halide grain also forms J association.

(15) The silver halide photographic material as described in any of the above items (1) to (14), wherein the silver halide photographic emulsion containing the compound represented by formula (1) or (2) is an emulsion in which tabular grains having an aspect ratio of 2 or more account for 50% (area) or more of the entire silver halide grains in the emulsion.

(16) The silver halide photographic material as described in any of the above items (1) to (15), wherein the silver halide photographic emulsion containing the compound represented by formula (1) or (2) is sensitized by selenium sensitization.

(17) A dye represented by the above formula (1).

(18) In the compound represented by the above formula (1), Dye 1 represents a first chromophore; Dye 2 represents a second chromophore; $L_1$ represents -$G_1$-$G_3$-$G_2$-; $G_1$ and $G_2$ each represents an alkylene group or an alkenylene group; $G_3$ represents a linking group having an arylene group, a heterylene group or a cycloalkylene group in the linking chain, and the total number of these groups is 2 or more; $R_1$ represents a dissociable group having pKa of 5 or less; $m_1$ represents an integer of from 1 to 5; $m_2$ represents an integer of from 1 to 5; and $m_3$ represents an integer of from 1 to 4.

(19) The silver halide photographic material as described in the above item (18), wherein in the compound represented by formula (1), $G_3$ is represented by -$A_1$-($G_4$-$A_2$-)$_{t1}$-; $G_4$ represents an arylene group, a heterylene group, a cycloalkylene group or a group containing these groups; $A_1$ and $A_2$ each represents —O—, —S—, —$SO_2$—, —$NR_2$—, —COO—, —$CONR_3$— or —$SO_2NR_4$— regardless of the groups of both sides; $R_2$, $R_3$ and $R_4$ each represents a hydrogen atom, an alkyl group, an alkenyl group, an aryl group or a heterocyclic group; and $t_1$ represents an integer of from 1 to 10.

(20) The silver halide photographic material as described in the above item (19), wherein in the compound represented by formula (1) $G_3$ represents an arylene group, a cycloalkylene group or a group containing these groups.

(21) The silver halide photographic material as described in the above item (19), wherein in the compound represented by formula (1), $G_3$ represents an arylene group or a group containing an arylene group.

(22) The silver halide photographic material as described in the above item (19), (20) or (21), wherein in the compound represented by formula (1), $A_1$ and $A_2$ each represents —O—, —$SO_2$—, —COO—, or —$CONR_3$—.

(23) The silver halide photographic material as described in any of the above items (18) to (22), wherein in the compound represented by formula (1), Dye 1 and Dye 2 each represents a cyanine chromophore, a merocyanine chromophore or an oxonol chromophore.

(24) The silver halide photographic material as described in any of the above items (18) to (23), wherein in the compound represented by formula (1), Dye 1 and Dye 2 each represents a cyanine chromophore or a merocyanine chromophore.

(25) The silver halide photographic material as described in any of the above items (18) to (24), wherein in the compound represented by formula (1), Dye 1 represents a cyanine chromophore and Dye 2 represents a cyanine chromophore or a merocyanine chromophore.

(26) The silver halide photographic material as described in any of the above items (18) to (25), wherein in the compound represented by formula (1), Dye 1 and Dye 2 each represents a cyanine chromophore.

(27) The silver halide photographic material as described in the above item (18), wherein the compound represented by formula (1) is represented by the following formula (3):

(3)

(Dye2)

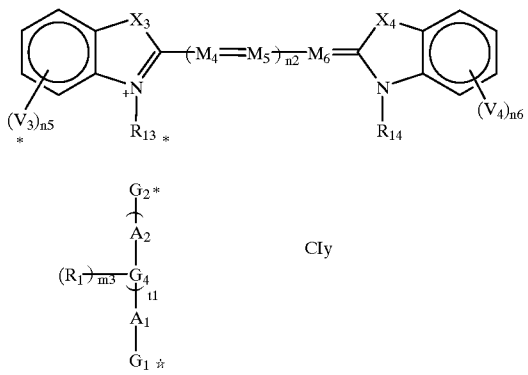

(Dye1)

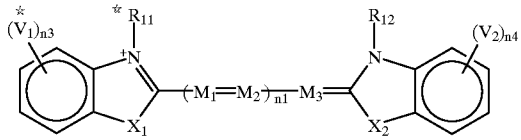

wherein $G_1$ and $G_2$ have the same meaning as described in the above item (18); $G_4$, $A_1$, $A_2$ and $t_1$ have the same meaning as described in the above item (19); $R_1$ represents $—SO_3M$, $—OSO_3M$, $—PO_3M_2$, $—OPO_3M_2$ Or —COOM; M represents a proton or a cation; $m_3$ represents an integer of from 1 to 4; $X_1$, $X_2$, $X_3$ and $X_4$ each represents —O—, —S—, $—NR_5—$ or $—CR_6R_7—$; $R_5$, $R_6$ and $R_7$ each represents a hydrogen atom, an alkyl group, an alkenyl group, an aryl group or a heterocyclic group; $R_{11}$, $R_{12}$, $R_{13}$ and $R_{14}$ each represents a hydrogen atom, an alkyl group, an alkenyl group, an aryl group or a heterocyclic group; $M_1$, $M_2$, $M_3$, $M_4$, $M_5$ and $M_6$ each represents a methine group; $n_1$ and $n_2$ each represents an integer of from 0 to 3; $V_1$, $V_2$, $V_3$ and $V_4$ each represents a substituent; $n_3$, $n_4$, $n_5$ and $n_6$ each represents an integer of from 0 to 4, when $n_3$, $n_4$, $n_5$ and $n_6$ each represents 2 or more, $V_1$, $V_2$, $V_3$ and $V_4$ may be the same or different, and they may be linked to each other to form a ring; CI represents an ion to neutralize electric charge; y represents a number necessary to neutralize electric charge; and $G_1$ is linked to Dye 1 via $R_{11}$ or $V_1$, and $G_2$ is linked to Dye 2 via $R_{13}$ or $V_3$.

(28) The silver halide photographic material as described in any of the above items (18) to (27), wherein in the compound represented by formula (1) or (3), $m_3$ represents an integer of from 1 to 4.

(29) The silver halide photographic material as described in the above item (28), wherein in the compound represented by formula (1) or (3), $R_1$ represents $—SO_3M$.

(30) The silver halide photographic material as described in any of the above items (27) to (29), wherein in the compound represented by formula (3), $X_1$ and $X_2$ each represents —O— or —S—.

(31) The silver halide photographic material as described in any of the above items (27) to (30), wherein in the compound represented by formula (3), $G_1$ is linked to $R_{11}$ and $G_2$ is linked to $R_{13}$.

(32) The silver halide photographic material as described in any of the above items (18) to (31), wherein in the compound represented by formula (1) or (3), the adsorptivity to a silver halide grain satisfies the relationship:

$$\text{Dye 1} \geqq \text{Dye 2} > L_1\text{-}(R_1)_{m3}$$

(33) The silver halide photographic material as described in any of the above items (18) to (32), wherein Dye 1 and Dye 2 in the compound represented by formula (1) or (3) have the same structure.

(34) The silver halide photographic material as described in any of the above items (18) to (33), wherein in the compound represented by formula (1) or (3), only one chromophore of Dye 1 or Dye 2 is adsorbed onto a silver halide grain, and when the chromophore not adsorbed onto a silver halide grain is excited by light, the chromophore not adsorbed onto a silver halide grain is transferred to the chromophore adsorbed onto a silver halide grain by electron transfer or energy transfer.

(35) The silver halide photographic material as described in any of the above items (18) to (34), wherein in the compound represented by formula (1) or (3) contained in the silver halide photographic emulsion, only one of Dye 1 or Dye 2 is adsorbed onto a silver halide grain and forms J association, and the chromophore which is not adsorbed onto a silver halide grain also forms J association.

(36) The silver halide photographic material as described in any of the above items (18) to (35), wherein the silver halide photographic emulsion containing the compound represented by formula (1) or (3) is an emulsion in which tabular grains having an aspect ratio of 2 or more account for 50% (area) or more of the entire silver halide grains in the emulsion.

(37) The silver halide photographic material as described in any of the above items (18) to (36), wherein the silver halide photographic emulsion containing the compound represented by formula (1) or (3) is sensitized by selenium sensitization.

(38) A dye represented by the above formula (3).

DETAILED DESCRIPTION OF THE INVENTION

The compound according to the present invention represented by formula (1) is described in detail below.

When the compound according to the present invention has an alkyl group, an alkylene group, an alkenyl group or an alkenylene group, these groups may be straight or branched chain, and substituted or unsubstituted, unless otherwise indicated.

Further, when the compound according to the present invention has a cycloalkyl group, an aryl group, a heterocyclic group, a cycloalkenylene group, an arylene group, or a heterylene group, these groups may be monocyclic or condensed, and substituted or unsubstituted, unless otherwise indicated.

When a specific moiety is called "group" in the present invention, it means that even if the specific moiety itself is not substituted, the compound may be substituted with one or more (as many as possible) substituents.

For example, "an alkyl group" means a substituted or unsubstituted alkyl group. In addition, the substituents which can be used in the compound according to the present invention include every substituent regardless of substitution. For example, the following substituent groups W can be exemplified.

The substituents W are not particularly restricted and any groups can be included, for example, a halogen atom, an alkyl group [(cycloalkyl, bicycloalkyl, tricycloalkyl are included), and an alkenyl group (cycloalkenyl, bicycloalkenyl are included) and an alkynyl group are also included], an aryl group, a heterocyclic group, a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkyl-sulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, a phospho group, a silyl group, a hydrazino group, a ureido group, and other well-known substituents can be exemplified.

Further in detail, the examples of W include a halogen atom (e.g., fluorine, chlorine, bromine, iodine), an alkyl group {[a straight chain, branched, cyclic, substituted or unsubstituted alkyl group including an alkyl group (preferably an alkyl group having from 1 to 30 carbon atoms, e.g., methyl, ethyl, n-propyl, isopropyl, t-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl), a bicycloalkyl group (preferably a substituted or unsubstituted bicycloalkyl group having from 5 to 30 carbon atoms, i.e., a monovalent group obtained by removing one hydrogen atom from a bicycloalkane group having from 5 to 30 carbon atoms, e.g., bicyclo[1,2,2]heptan-2-yl, bicyclo[2,2,2]octan-3-yl), and a tricyclohexyl structure having more ring structures; the alkyl group in the substituent described below (e.g., the alkyl group in an alkylthio group) represents the alkyl group of such a concept, in addition to the above, an alkenyl group and an alkynyl group are also included], an alkenyl group [a straight chain, branched, cyclic, substituted or unsubstituted alkenyl group including an alkenyl group (preferably a substituted or unsubstituted alkenyl group having from 2 to 30 carbon atoms, e.g., vinyl, allyl, prenyl, geranyl, oleyl, a cycloalkenyl group (preferably a substituted or unsubstituted cycloalkenyl group having from 3 to 30 carbon atoms, i.e., a monovalent group obtained by removing one hydrogen atom from a cycloalkene group having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, i.e., a monovalent group obtained by removing one hydrogen atom from a bicycloalkene group having one double bond, e.g., bicyclo[2,2,1]hepto-2-en-1-yl, bicyclo [2,2,2]octo-2-en-4-yl)], an alkynyl group (preferably a substituted or unsubstituted alkynyl group having from 2 to 30 carbon atoms, e.g., ethynyl, propargyl, trimethylsilylethynyl),an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a 5- or 6-membered, substituted or unsubstituted, aromatic or non-aromatic monovalent group obtained by eliminating one hydrogen atom from a heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl, further, acationic heterocyclic group, e.g., 1-methyl-2-pyridinio, 1-methyl-2-quinolinio may also be included), a cyano group, a hydroxyl group, a nitro group, a carboxyl group, an alkoxyl group (preferably a substituted or unsubstituted alkoxyl group having from 1 to 30 carbon atoms, e.g., methoxy, ethoxy, isopropoxy, t-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-t-butylphenoxy, 3-nitrophenoxy, 2-tetradecanoylaminophenoxy), a silyloxy group (preferably a silyloxy group having from 3 to 20 carbon atoms, e.g., trimethylsilyloxy, t-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms, a substituted or unsubstituted arylcarbonyloxy group having from 6 to 30 carbon atoms, e.g., formyloxy, acetyloxy, pivaloyloxy, stearoyloxy, benzoyloxy, p-methoxy-phenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, t-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxy-phenoxycarbonyloxy), an amino group (preferably an amino group, a substituted or unsubstituted alkylamino group having from 1 to 30 carbon atoms, a substituted or unsubstituted anilino group having from 6 to 30 carbon atoms, e.g., amino, methylamino, dimethylamino, anilino, N-methylanilino, diphenylamino), an ammonio group (preferably an ammonio group, an ammonio group substituted with a substituted or unsubstituted alkyl group having from 1 to 30 carbon atoms, an aryl group or a heterocyclic group, e.g., trimethylammonio, triethylammonio, diphenylmethylammonio), an acylamino group (preferably a formylamino group, a substituted or unsubstituted alkylcarbonylamino group having from 1 to 30 carbon atoms, a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an amino-carbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, t-butoxycarbonylamino, n-octadecyloxycarbonylamino, N-methylmethoxycarbonylamino), an aryloxycarbonylamino group (preferably a substituted or unsubstituted aryloxycarbonyl-amino group having from 7 to 30 carbon atoms, e.g., phenoxycarbonylamino, p-chlorophenoxycarbonylamino, m-(n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkylsulfonylamino group and arylsulfonylamino group (preferably a substituted or unsubstituted alkylsulfonylamino group having from 1 to 30 carbon atoms, a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methyl-phenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkylsulfinyl group and arylsulfinyl group (preferably a substituted or unsubstituted alkylsulfinyl group having from 1 to 30 carbon atoms, a substituted or unsubstituted arylsulfinyl group having from 6 to 30 carbon atoms, e.g., methylsulfinyl, ethylsulfinyl, phenylsulfinyl, p-methylphenylsulfinyl), an alkylsulfonyl group and arylsulfonyl group (preferably a substituted or unsubstituted alkylsulfonyl group having from 1 to 30 carbon atoms, a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having from 4 to 30 carbon atoms bonded to a carbonyl group via a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-t-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, t-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an arylazo group and heterocyclic azo group (preferably a substituted or unsubstituted arylazo group having from 6 to 30 carbon atoms, a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, t-butyl-dimethylsilyl, phenyldimethylsilyl), a hydrazino group (preferably a substituted or unsubstituted hydrazino group having from 0 to 30 carbon atoms, e.g., trimethylhydrazino), and a ureido group (preferably a substituted or unsubstituted ureido group having from 0 to 30 carbon atoms, e.g., N,N-dimethylureido).

Substituents W may be bonded to each other and condensed to form a ring structure. For example, an aromatic or non-aromatic hydrocarbon ring or heterocyclic ring may further be linked to form a polycyclic condensed ring. Examples of such rings include a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, an isoquinoline ring, a phthalazine ring, a naphthyridine ring, a quinoxaline ring, a quinoxazoline ring, a carbazole ring, a phenanthridine ring, an acridine ring, a phenanthroline ring, a thianthrene ring, a chromene ring, a xanthene ring, a phenoxthine ring, a phenothiazine ring, and a phenazine ring.

Of the above substituents W, those having hydrogen atoms may be substituted with the above groups after removing the hydrogen atoms therefrom. As the examples of such substituents, an alkylcarbonylaminosulfonyl group, an aryl-carbonylaminosulfonyl group, an alkylsulfonylaminocarbonyl group, and an arylsulfonylaminocarbonyl group, and the examples of the substituted groups include a methylsulfonylaminocarbonyl group, a p-methylphenylsulfonylaminocarbonyl group, an acetylaminosulfonyl group, and a benzoylaminosulfonyl group.

In formula (1), $R_1$ represents a dissociable group having pKa of 5 or less. The pKa in the present invention is a value in water at 25° C. With respect to pKa value, *Kagaku Binran, Kisohen* (*Chemical Handbook, Elementary Course*), pp. II-316 to II-321, and Shu Iwamura compiled, *Daigakuin Yuki Kagaku, Jo* (*Organic Chemistry, Postgraduate Course, Vol. One*), pp. 168 and 169 can be referred to.

$R_1$ preferably represents —$SO_3M$, —$OSO_3M$, —$PO_3M_2$, —$OPO_3M_2$ or —COOM, and M represents a proton or a cation (the preferred examples are the same as those of the cations described later in the item of CI), and $R_1$ more preferably represents —$SO_3M$.

$m_3$ represents an integer of from 1 to 4, preferably 1 or 2. When $m_3$ represents 2 or more, $R_1$ may be the same or different.

$L_1$ represents a linking chain, or $L_1$ may be a mere alkylene group (preferably an alkylene group having from 1 to 20 carbon atoms, e.g., methylene, ethylene, propylene, butylene, hexylene, octylene, 2-methylbutylene, 3-phenylpentylene), or alkenylene group (preferably an alkenylene group having from 2 to 20 carbon atoms, e.g., ethenylene, propenylene, 2-butenylene), and at that time, $R_1$ may substitute anywhere, but preferably $L_1$ is represented by $-G_1-(A_1-G_2-)_{t1}-$.

$G_1$ and $G_2$ each represents an alkylene group or an alkenylene group (the preferred examples are the same as the examples of $L_1$), preferably an alkylene group.

$L_1$ more preferably represents $-G_1-G_3-G_2-$, $G_1$ and $G_2$ each represents an alkylene group (preferably an alkylene group having from 1 to 20 carbon atoms, e.g., methylene, ethylene, propylene, butylene, hexylene, octylene, 2-methylbutylene, 3-phenylpentylene), or an alkenylene group (preferably an alkenylene group having from 2 to 20 carbon atoms, e.g., ethenylene, propenylene, 2-butenylene), preferably an alkylene group, more preferably a straight chain unsubstituted alkylene group having from 1 to 8 carbon atoms.

$G_3$ represents a linking group having, in the linking chain, an arylene group (preferably an arylene group having from 6 to 26 carbon atoms, e.g., 1,4-phenylene, 1,4-naphthylene), a heterylene group (i.e., a divalent group of a heterocyclic group) (preferably a heterylene group having from 1 to 26 carbon atoms, e.g., 2,5-thienylene, 2,5-furanylene, 2,5-pyrolylene, pyrimidinylene, 2,5-pyrimidylene, 1,4-piperazinylene, 2,5-thiazolylene, 2,5-oxazolylene), or a cycloalkylene group (preferably a cycloalkylene group having from 3 to 20 carbon atoms, e.g., 1,4-cyclohexylene, 1,3-cyclopentylene), and the total number of these groups is 2 or more.

These rings may be substituted with the above-described substituents W.

$G_3$ preferably represents a linking group having an arylene group or a cycloalkylene group in total of 2 or more, more preferably represents a linking group having 2 or more arylene groups.

When $m_3$ represents 1 or more, $R_1$ may substitute on any of $G_1$, $G_2$ and $G_3$, but it is preferred to substitute on $G_3$.

$G_3$ is preferably represented by $-A_1-(G_4-A_2-)_{t1}-$. Here, $G_4$ represents an arylene group, a heterylene group, a cycloalkylene group or a group containing these groups, preferably an arylene group, a cycloalkenylene group or a group containing these groups, and more preferably an arylene group or a group containing an arylene group.

$A_1$ and $A_2$ each represents —O—, —S—, —$SO_2$—, —$NR_2$—, —COO—, —$CONR_3$— or —$SO_2NR_4$— regardless of the groups of both sides, $R_2$, $R_3$ and $R_4$ each represents a hydrogen atom, an alkyl group (preferably an unsubstituted alkyl group having from 1 to 18, more preferably from 1 to 7, and particularly preferably from 1 to 4, carbon atoms (e.g., methyl, ethyl, propyl, isopropyl, butyl, isobutyl, hexyl, octyl, 2-ethylhexyl, dodecyl, octadecyl), a substituted alkyl group having from 1 to 18, more preferably from 1 to 7, and particularly preferably from 1 to 4, carbon atoms [e.g., an alkyl group substituted with the above-described substituent W can be exemplified, preferably an aralkyl group (e.g., benzyl, 2-phenylethyl), a hydroxyalkyl group (e.g., 2-hydroxyethyl, 3-hydroxypropyl, 6-hydroxyhexyl), a carboxyalkyl group (e.g., 2-carboxyethyl, 3-carboxypropyl, 4-carboxybutyl, carboxymethyl, 5-carboxypentyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfobenzyl, 3-sulfo-3-phenylpropyl, 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), an alkylsulfonylcarbamoylalkyl group (e.g., methanesulfonyl-carbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl), a halogen-substituted alkyl group (e.g., 2-chloroethyl, 2,2,2-trifluoroethyl), an alkenyl group (preferably an alkenyl group having from 2 to 20 carbon atoms, e.g., vinyl, allyl, 3-butenyl, oleyl, an alkenyl group substituted with the above substituent W, e.g., a sulfoalkenyl group (e.g., 3-sulfo-2-propenyl)), an aryl group (an unsubstituted aryl group having from 6 to 20, preferably from 6 to 10, and more preferably from 6 to 8, carbon atoms (e.g., phenyl, 1-naphthyl, 2-naphthyl), and a substituted aryl group having from 6 to 20, preferably from 6 to 10, and more preferably from 6 to 8, carbon atoms (e.g., aryl groups substituted with W described above, specifically p-methoxyphenyl, p-methylphenyl, p-chlorophenyl can be exemplified)), a heterocyclic group (an unsubstituted heterocyclic group having from 1 to 20, preferably from 3 to 10, and more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, and more preferably from 4 to 8, carbon atoms (e.g., heterocyclic groups substituted with the above-described W, specifically 5-methyl-2-thienyl, 4-methoxy-2-pyridyl)).

When $R_2$, $R_3$ and $R_4$ are each substituted with a dissociable group, the dissociable group may be regarded as $R_1$.

$R_2$ preferably represents a hydrogen atom or an alkyl group, more preferably an alkyl group.

$R_3$ and $R_4$ preferably represent a hydrogen atom, an alkyl group or a sulfoalkyl group, more preferably a hydrogen atom.

$A_1$ and $A_2$ each preferably represents —O—, —$SO_2$—, —COO— or —$CONR_3$—, more preferably —$SO_2$—, —COO— or —$CONR_3$—.

$t_1$ represents an integer of from 1 to 10, preferably an integer of from 1 to 4, and when $t_1$ represents 2 or more, a plurality of $G_2$, $G_4$, $A_1$ and $A_2$ may be the same or different.

When $m_3$ represents 1 or more, $R_1$ may substitute on any of $G_1$, $G_2$, $G_4$, $R_2$, $R_3$ and $R_4$, but it is preferred to substitute on $G_4$.

$m_1$ represents an integer of from 1 to 5, preferably 1 or 2, and more preferably 1. $m_2$ represents an integer of from 1 to 5, preferably 1 or 2, and more preferably 1.

The chromophores represented by Dye 1 and Dye 2 are not restricted and any chromophores can be used, for example, a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, and a metallic complex dye can be exemplified.

The preferred examples of these are polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, and an azamethine dye.

These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Clause 14, pp. 482 to 515. As the preferred formulae of the dyes, the formulae on pages 32 to 36 in U.S. Pat. No. 5,994,051, and the formulae on pages 30 to 34 in U.S. Pat. No. 5,747,236 can be exemplified. Further, formulae (XI), (XII) and (XIII), columns 21 and 22 in U.S. Pat. No. 5,340,694 can be exemplified as the preferred formulae of cyanine, merocyanine and rhodacyanine dyes, respectively (however, the numbers of $n_{12}$, $n_{15}$, $n_{17}$ and $n_{18}$ are not restricted here and regarded as the integers of 0 or more (preferably 4 or less)).

Dye 1 and Dye 2 preferably represent any of a cyanine chromophore, a merocyanine chromophore and an oxonol chromophore, more preferably a cyanine chromophore or a merocyanine chromophore, still more preferably Dye 1 represents a cyanine chromophore, and most preferably Dye 1 and Dye 2 both represent cyanine chromophores.

The cyanine chromophore is preferably represented by the following formula (4):

(4)

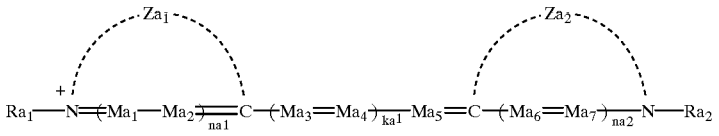

CIy wherein $Za_1$ and $Za_2$ each represents an atomic group necessary to form a 5- or 6-membered nitrogen-containing heterocyclic ring, and each group may be further condensed with a ring, e.g., a benzene ring, a benzofuran ring, a pyridine ring, a pyrrole ring, an indole ring, or a thiophene ring.

$Ra_1$ and $Ra_2$ each represents a hydrogen atom, an alkyl group, an alkenyl group, an aryl group or a heterocyclic group (the preferred examples of these groups are the same as those in $R_2$, $R_3$ and $R_4$), preferably a hydrogen atom, an alkyl group or a sulfoalkyl group, and more preferably an alkyl group or a sulfoalkyl group.

$Ma_1$, $Ma_2$, $Ma_3$, $Ma_4$, $Ma_5$, $Ma_6$ and $Ma_7$ each represents a methine group and each group may have a substituent. As the substituents, any of the above substituent groups W maybe used, but as preferred substituents, e.g., an alkyl group having from 1 to 20 carbon atoms (e.g., methyl, ethyl, 1-propyl), a halogen atom (e.g., chlorine, bromine, iodine, fluorine), a nitro group, an alkoxyl group having from 1 to 20 carbon atoms (e.g., methoxy, ethoxy), an aryl group having from 6 to 20 carbon atoms (e.g., phenyl, 2-naphthyl), a heterocyclic group having from 0 to 20 carbon atoms (e.g., 2-pyridyl, 3-pyridyl), an aryloxy group having from 6 to 20 carbon atoms (e.g., phenoxy, 1-naphthoxy, 2-naphthoxy), an acylamino group having from 1 to 20 carbon atoms (e.g., acetylamino, benzoylamino), a carbamoyl group having from 1 to 20 carbon atoms (e.g., N,N-dimethylcarbamoyl), a sulfo group, a hydroxyl group, a carboxyl group, an alkylthio group having from 1 to 20 carbon atoms (e.g., methylthio), and a cyano group can be exemplified. Each of these methine groups may form a ring together with other methine groups or can form a ring together with an auxochrome. $Ma_1$ to $Ma_7$ each preferably represents an unsubstituted, ethyl-substituted or methyl-substituted methine group.

$na^1$ and $na^2$ each represents 0 or 1, preferably 0. $ka^1$ represents an integer of from 0 to 3, preferably an integer of from 0 to 2, and more preferably 0 or 1. When $ka^1$ represents 2 or more, $Ma_3$ and $Ma_4$ may be the same or different.

CI represents an ion to neutralize electric charge and y represents a number necessary to neutralize electric charge.

The merocyanine chromophore is preferably represented by the following formula (5):

(5)

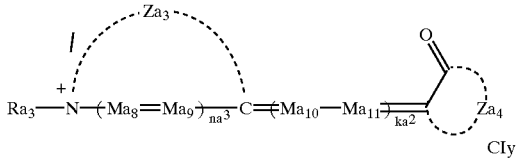

CIy wherein $Za_3$ represents an atomic group necessary to form a 5- or 6-membered nitrogen-containing heterocyclic ring, and the group may be further condensed with a ring, e.g., a benzene ring, a benzofuran ring, a pyridine ring, a pyrrole ring, an indole ring, or a thiophene ring. $Za_4$ represents an atomic group necessary to form an acidic nucleus. $Ra_3$ represents a hydrogen atom, an alkyl group, an alkenyl group, an aryl group or a heterocyclic group (the preferred examples of these groups are the same as those in $Ra^1$ and $Ra_2$). $Ma_8$, $Ma_9$, $Ma_{10}$ and $Ma_{11}$ each represents a methine group (the preferred examples are the same as those in $Ma_1$ to $Ma_7$). na represents 0 or 1. $ka^1$ represents an integer of from 0 to 3, preferably an integer of from 0 to 2, and more preferably 1 or 2. When $ka_2$ represents 2 or more, $Ma_{10}$ and $Ma_{11}$ may be the same or different.

CI represents an ion to neutralize electric charge and y represents a number necessary to neutralize electric charge.

The oxonol chromophore is preferably represented by the following formula (6):

(6)

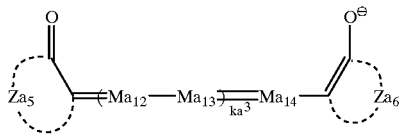

CIy wherein $Za_5$ and $Za_6$ each represents an atomic group necessary to form an acidic nucleus. $Ma_{12}$, $Ma_{13}$ and $Ma_{14}$ each represents a methine group (the preferred examples are the same as those in $Ma_1$ to $Ma_7$). $ka^3$ represents an integer of from 0 to 3, preferably an integer of from 0 to 2. When $ka^3$ represents 2 or more, $Ma_{12}$ and $Ma_3$ may be the same or different.

CI represents an ion to neutralize electric charge and y represents a number necessary to neutralize electric charge.

$Za_1$, $Za_2$ and $Za_3$ each represents an oxazole nucleus having from 3 to 25 carbon atoms (e.g., 2-3-methyloxazolyl, 2-3-ethyloxazolyl, 2-3,4-diethyloxazolyl, 2-3-methylbenzoxazolyl, 2-3-ethylbenzoxazolyl, 2-3-sulfoethylbenzoxazolyl, 2-3-sulfopropylbenzoxazolyl, 2-3-methylthioethylbenzoxazolyl, 2-3-methoxyethylbenzoxazolyl, 2-3-sulfobutylbenzoxazolyl, 2-3-methyl-β-naphthoxazolyl, 2-3-methyl-α-naphthoxazolyl, 2-3-sulfopropyl-β-naphthoxazolyl, 2-3-sulfopropyl-γ-naphthoxazolyl, 2-3-(3-naphthoxyethyl) benzoxazolyl, 2-3,5-dimethylbenzoxazolyl, 2-6-chloro-3-methylbenzoxazolyl, 2-5-bromo-3-methylbenzoxazolyl, 2-3-ethyl-5-methoxybenzoxazolyl, 2-5-phenyl-3-sulfopropylbenzoxazolyl, 2-5-(4-bromophenyl)-3-sulfobutylbenzoxazolyl, 2-3-dimethyl-5,6-dimethylthiobenzoxazolyl), a thiazole nucleus having from 3 to 25 carbon atoms (e.g., 2-3-methylthiazolyl, 2-3-ethylthiazolyl, 2-3-sulfopropylthiazolyl, 2-3-sulfobutylthiazolyl, 2-3,4-dimethylthiazolyl, 2-3,4,4-trimethylthiazolyl, 2-3-carboxyethylthiazolyl, 2-3-methylbenzothiazolyl, 2-3-ethylbenzothiazolyl, 2-3-butylbenzothiazolyl, 2-3-sulfopropylbenzothiazolyl, 2-3-sulfobutylbenzothiazolyl, 2-3-methyl-β-naphthothiazolyl, 2-3-sulfopropyl-γ-naphthothiazolyl, 2-3-(1-naphthoxyethyl) benzothiazolyl, 2-3,5-dimethylbenzothiazolyl, 2-6-chloro-3-methylbenzothiazolyl, 2-6-iodo-3-ethylbenzo-thiazolyl, 2-5-bromo-3-methylbenzothiazolyl, 2-3-ethyl-5-methoxybenzothiazolyl, 2-5-phenyl-3-sulfopropylbenzothiazolyl, 2-5-(4-bromophenyl)-3-sulfobutylbenzothiazolyl, 2-3-dimethyl-5,6-dimethylthiobenzothiazolyl), an imidazole nucleus having from 3 to 25 carbon atoms (e.g., 2-1,3-diethylimidazolyl, 2-1,3-dimethylimidazolyl, 2-1-methylbenzimidazolyl, 2-1,3,4-triethylimidazolyl, 2-1,3-diethylbenzimidazolyl, 2-1,3,5-trimethylbenzimidazolyl, 2-6-chloro-1,3-dimethylbenzimidazolyl, 2-5,6-dichloro-1,3-diethylbenzimidazolyl, 2-1,3-disulfopropyl-5-cyano-6-chlorobenzimidazolyl), an indolenine nucleus having from 10 to 30 carbon atoms (e.g., 3,3-dimethylindolenine), a quinoline nucleus having from 9 to 25 carbon atoms (e.g., 2-1-methylquinolyl, 2-1-ethylquinolyl, 2-1-methyl-6-chloroquinolyl, 2-1,3-diethylquinolyl, 2-1-methyl-6-methylthioquinolyl, 2-1-sulfopropylquinolyl, 4-1-methylquinolyl, 4-1-sulfoethylquinolyl, 4-1-methyl-7-chloroquinolyl, 4-1,8-diethylquinolyl, 4-1-methyl-6-methylthioquinolyl, 4-1-sulfopropylquinolyl), a selenazole nucleus having from 3 to 25 carbon atoms (e.g., 2-3-methylbenzoselenazolyl), or a pyridine nucleus having from 5 to 25 carbon atoms (e.g., 2-pyridyl).

These nuclei may be substituted and the above-described substituent groups W can be exemplified as the substituents, but as preferred substituents, e.g., an alkyl group (e.g., methyl, ethyl, propyl), a halogen atom (e.g., chlorine, bromine, iodine, fluorine), a nitro group, an alkoxyl group (e.g., methoxy, ethoxy), an aryl group (e.g., phenyl), a heterocyclic group (e.g., 2-pyridyl, 3-pyridyl, 1-pyrrolyl, 2-thienyl), an aryloxy group (e.g., phenoxy), an acylamino group (e.g., acetylamino, benzoylamino), a carbamoyl group (e.g., N,N-dimethylcarbamoyl), a sulfo group, a sulfonamido group (e.g., methanesulfonamido), a sulfamoyl group (e.g., N-methylsulfamoyl), a hydroxyl group, a carboxyl group, an alkylthio group (e.g., methylthio), and a cyano group can be exemplified.

$Za_1$, $Za_2$ and $Za_3$ each preferably represents an oxazole nucleus, an imidazole nucleus or a thiazole nucleus. These heterocyclic rings may further be condensed with, e.g., a benzene ring, a benzofuran ring, a pyridine ring, a pyrrole ring, an indole ring, or a thiophene ring.

$Za_4$, $Za_5$ and $Za_6$ each represents an atomic group necessary to form an acidic nucleus. The acidic nucleus is defined, for example, in James, *The Theory of the Photographic Process,* 4th Ed.,p. 198, Macmillan (1977). Specifically, the following nuclei are exemplified, e.g., 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isorhodanine, rhodanine, indane-1,3-dione, thiophen-3-one, thiophen-3-one-1,1-dioxide, indolin-2-one, indolin-3-one, 2-oxoindazolinium, 5,7-dioxo-6,7-dihydrothiazolo[3,2-a] pyrimidine, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, and pyrazolopyridone.

Of these, the preferred are hydantoin, rhodanine, barbituric acid and 2-oxazolin-5-one, and $Za_4$ more preferably represents barbituric acid.

The specific examples of cyanine chromophores, merocyanine chromophores and oxonol chromophores are described in F. M. Harmer, *Heterocyclic Compounds—Cyanine Dyes and Related Compounds,* John Wiley & Sons, New York, London (1964).

As the formulae of cyanine dyes and merocyanine dyes, formulae (XI) and (XII) disclosed on pages 21 and 22 in U.S. Pat. No. 5,340,694 are preferably used.

The compound represented by formula (1) according to the present invention is more preferably represented by formula (2) or (3).

In formula (2), $G_1$, $G_2$, $A_1$ and $t_1$ have the same meaning as described in claim 3. $R_1$ represents —$SO_3M$, —$OSO_3M$, —$PO_3M_2$, —$OPO_3M_2$ or —COOM, M represents a proton or a cation, $R_1$ preferably represents —$SO_3M$. $m_3$ represents an integer of from 1 to 4, preferably 1 or 2. When $m_3$ represents 2 or more, $R_1$ may be the same or different. $R_1$ may substitute on any of $G_1$, $G_2$ and $A_1$.

$X_1$, $X_2$, $X_3$ and $X_4$ each represents —O—, —S—, —$NR_5$— or —$CR_6R_7$—, $R_5$ represents a hydrogen atom, an alkyl group, an alkenyl group, an aryl group or a heterocyclic group (the preferred examples of these groups are the same as those in $R_2$, $R_3$ and $R_4$), preferably a hydrogen atom, an alkyl group or a sulfoalkyl group, and more preferably an alkyl group or a sulfoalkyl group. $R_6$ and $R_7$ each represents a hydrogen atom, an alkyl group, an alkenyl group, an aryl group or a heterocyclic group (the preferred examples of these groups are the same as those in $R_2$, $R_3$ and $R_4$), preferably an alkyl group.

$X_1$, $X_2$, $X_3$ and $X_4$ each preferably represents —O— or —S—, and more preferably all of $X_1$, $X_2$, $X_3$ and $X_4$ represent —S—.

$R_{11}$, $R_{12}$, $R_{13}$ and $R_{14}$ each represents a hydrogen atom, an alkyl group, an alkenyl group, an aryl group or a heterocyclic group (the preferred examples of these groups are the same as those in $Ra_1$ and $Ra_2$), preferably a hydrogen atom, an alkyl group or a sulfoalkyl group.

$M_1$, $M_2$, $M_3$, $M_4$, $M_5$ and $M_6$ each represents a methine group (the preferred examples are the same as those in $Ma_1$ to $Ma_{14}$), preferably an unsubstituted, ethyl-substituted or methyl-substituted methine group.

$n_1$ and $n_2$ each represents an integer of from 0 to 3, preferably an integer of from 0 to 2, and more preferably 0 or 1. When $n_1$ and $n_2$ each represents 2 or more, $M_1$, $M_2$, $M_4$ and $M_5$ may be the same or different.

$n_1$ and $n_2$ are preferably the same.

Further, when $n_1$ is 0, $X_1$ and $X_2$ each preferably represents —S—, and when $n_1$ is 1, $X_1$ and $X_2$ each preferably represents —O—.

It is particularly preferred that both of $n_1$ and $n_2$ are 0 and all of $X_1$, $X_2$, $X_3$ and $X_4$ represent —S—.

$V_1$, $V_2$, $V_3$ and $V_4$ each represents a substituent, as the substituents, any of the above substituent groups W may be used, but as preferred substituents, e.g., an alkyl group having from 1 to 20 carbon atoms (the preferred examples are the same as those in $R_2$, $R_3$ and $R_4$), a halogen atom (e.g., chlorine, bromine, iodine, fluorine), a nitro group, an alkoxyl group having from 1 to 20 carbon atoms (e.g., methoxy, ethoxy), an aryl group having from 6 to 20 carbon atoms (e.g., phenyl, 2-naphthyl), a heterocyclic group having from 0 to 20 carbon atoms (e.g., 2-pyridyl, 3-pyridyl, 1-pyrrolyl, 2-thienyl), an aryloxy group having from 6 to 20 carbon atoms (e.g., phenoxy, 1-naphthoxy, 2-naphthoxy), an acylamino group having from 1 to 20 carbon atoms (e.g., acetylamino, benzoylamino), a carbamoyl group having from 1 to 20 carbon atoms (e.g., N,N-dimethylcarbamoyl), a sulfo group, a sulfonamido group having from 0 to 20 carbon atoms (e.g., methanesulfonamido) a sulfamoyl group having from 0 to 20 carbon atoms (e.g., N-methylsulfamoyl), a hydroxyl group, a carboxyl group, an alkylthio group having from 1 to 20 carbon atoms (e.g., methylthio), and a cyano group can be exemplified. $V_1$, $V_2$, $V_3$ and $V_4$ each preferably represents an alkyl group, a halogen atom (in particular, chlorine, bromine), an aryl group, an acylamino group, a carbamoyl group, an alkoxyl group, a hydroxyl group, a sulfo group, or a carboxyl group, and preferred substitution positions are the 5-position, 6-position, 5'-position and 6'-position. $n_3$, $n_4$, $n_5$ and n6 each represents an integer of from 0 to 4, and preferably from 0 to 2. When $n_3$, $n_4$, $n_5$ and $n_6$ each represents 2 or more, $V_1$, $V_2$, $V_3$ and $V_4$ maybe the same or different, and they may be linked to each other to form a ring, e.g., a benzene ring, a pyridine ring, a benzofuran ring, a thiophene ring, a pyrrole ring, and an indole ring, more preferably a benzene ring and a benzofuran ring.

$G_1$ is linked to Dye 1 via $R_{11}$ or $V_1$, and $G_2$ is linked to Dye 2 via $R_{13}$ or $V_3$. At that time, the groups obtained by removing one hydrogen atom from the respective terminals of $G_1$, $G_2$, $R_{11}$, $R_{13}$, $V_1$ and $V_3$ are to be linked to each other but this does not mean that the production is performed by such a synthesis method.

As the preferred examples of $V_1$ and $V_3$ when linked to $G_1$ and $G_2$, a carboxyl group, an alkoxyl group, an acylamino group, a carbamoyl group, a sulfonamido group, a sulfamoyl group, a hydroxyl group and an alkylthio group are exemplified, more preferably an acylamino group and a carbamoyl group.

It is preferred that $G_1$ is linked to $R_{11}$ and $G_2$ is linked to $R_{13}$ respectively and both $R_{11}$ and $R_{13}$ represent hydrogen atoms at that time.

CI represents an ion to neutralize electric charge. Whether a compound is a cation or an anion, or whether a compound has net ionic charge depends upon the substituent. Representative cations are an ammonium ion and an alkali metal ion, and anions may be either inorganic ions or organic ions.

The examples of cations include, e.g., a sodium ion, a potassium ion, a triethylammonium ion, a diethyl(i-propyl)-ammonium ion, a pyridinium ion and a 1-ethylpyridinium ion, and the examples of anions include, e.g., a halogen anion (e.g., a chlorine ion, a bromine ion, a fluorine ion, an iodine ion), a substituted arylsulfonic acid ion (e.g., apara-toluensulfonic acid ion), an alkylsulfuric acid ion (e.g., a methylsulfuric acid ion), a sulfuric acid ion, a perchloric acid ion, a tetrafluoroboric acid and an acetic acid ion. y represents a number necessary to neutralize electric charge.

In formula (3), $G_1$, $G_2$, $G_4$, $A_1$, $A_2$ and $t_1$ have the same meaning as described in claims 8 and 9. $R_1$ represents —$SO_3M$, —$OSO_3M$, —$PO_3M_2$, —$OPO_3M_2$ or —COOM, M represents a proton or a cation, $R_1$ preferably represents —$SO_3M$. $m_3$ represents an integer of from 0 to 4, preferably from 1 to 4, and more preferably 1 or 2. When $m_3$ represents 1 or more, $R_1$ may substitute on any of $G_1$, $G_2$, $G_4$, $A_1$ and $A_2$, but preferably $R_1$ substitutes on any of $G_4$, $A_1$ and $A_2$, and more preferably on $G_4$. When $m_3$ represents 2 or more, $R_1$ may be the same or different.

$X_1$, $X_2$, $X_3$ and $X_4$ each represents —O—, —S—, —$NR_5$— or —$CR_6R_7$—, $R_5$ represents a hydrogen atom, an alkyl group, an alkenyl group, an aryl group or a heterocyclic group (the preferred examples of these groups are the same as those in $R_2$, $R_3$ and $R_4$), preferably a hydrogen atom, an alkyl group or a sulfoalkyl group, and more preferably an alkyl group or a sulfoalkyl group. $R_6$ and $R_7$ each represents a hydrogen atom, an alkyl group, an alkenyl group, an aryl group or a heterocyclic group (the preferred examples of these groups are the same as those in $R_2$, $R_3$ and $R_4$), preferably an alkyl group. $X_1$, $X_2$, $X_3$ and $X_4$ each preferably represents —O— or —S—.

$R_{11}$, $R_{12}$, $R_{13}$ and $R_{14}$ each represents a hydrogen atom, an alkyl group, an alkenyl group, an aryl group or a heterocyclic group (the preferred examples of these groups are the same as those in $Ra^1$ and $Ra_2$), preferably a hydrogen atom, an alkyl group or a sulfoalkyl group.

$M_1$, $M_2$, $M_3$, $M_4$, $M_5$ and $M_6$ each represents a methine group (the preferred examples are the same as those in $Ma_1$ to $Ma_{14}$) preferably an unsubstituted, ethyl-substituted or methyl-substituted methine group.

$n_1$ and $n_2$ each represents an integer of from 0 to 3, preferably an integer of from 0 to 2, and more preferably 0 or 1. When $n_1$ and $n_2$ each represents 2 or more, $M_1$, $M_2$, $M_4$ and $M_5$ may be the same or different. $n_1$ and $n_2$ are preferably the same.

Further, when $n_1$ is 0, $X_1$ and $X_2$ each preferably represents —S—, and when $n_1$ is 1, $X_1$ and $X_2$ each preferably represents —O—.

$V_1$, $V_2$, $V_3$ and $V_4$ each represents a substituent, as the substituents, any of the above substituent groups W may be used, but as preferred substituents, e.g., an alkyl group having from 1 to 20 carbon atoms (the preferred examples are the same as those in $R_2$, $R_3$ and $R_4$), a halogen atom (e.g., chlorine, bromine, iodine, fluorine), a nitro group, an alkoxyl group having from 1 to 20 carbon atoms (e.g., methoxy, ethoxy), an aryl group having from 6 to 20 carbon atoms (e.g., phenyl, 2-naphthyl), a heterocyclic group having from 0 to 20 carbon atoms (e.g., 2-pyridyl, 3-pyridyl, 1-pyrrolyl, 2-thienyl), an aryloxy group having from 6 to 20 carbon atoms (e.g., phenoxy, 1-naphthoxy, 2-naphthoxy), an acylamino group having from 1 to 20 carbon atoms (e.g., acetylamino, benzoylamino), a carbamoyl group having from 1 to 20 carbon atoms (e.g., N,N-dimethylcarbamoyl), a sulfo group, a sulfonamido group having from 0 to 20 carbon atoms (e.g., methanesulfonamido) a sulfamoyl group having from 0 to 20 carbon atoms (e.g., N-methylsulfamoyl), a hydroxyl group, a carboxyl group, an alkylthio group having from 1 to 20 carbon atoms (e.g., methylthio), and a cyano group can be exemplified.

$V_1$, $V_2$, $V_3$ and $V_4$ each preferably represents an alkyl group, a halogen atom (in particular, chlorine, bromine), an aryl group, an acylamino group, a carbamoyl group, an alkoxyl group, a hydroxyl group, a sulfo group, or a carboxyl group, and preferred substitution positions are the 5-position, 6-position, 5'-position and 6'-position.

$n_3$, $n_4$, $n_5$ and $n_6$ each represents an integer of from 0 to 4, and preferably from 0 to 2. When $n_3$, $n_4$, $n_5$ and $n_6$ each represents 2 or more, $V_1$, $V_2$, $V_3$ and $V_4$ maybe the same or different, and they may be linked to each other to form a ring, e.g., a benzene ring, a pyridine ring, a benzofuran ring, a thiophene ring, a pyrrole ring, and an indole ring, more preferably a benzene ring and a benzofuran ring.

$G_1$ is linked to Dye 1 via $R_{11}$ or $V_1$, and $G_2$ is linked to Dye 2 via $R_{13}$ or $V_3$. At that time, the groups obtained by removing one hydrogen atom from the respective terminals of $G_1$, $G_2$, $R_{11}$, $R_{13}$, $V_1$ and $V_3$ are to be linked to each other but this does not mean that the production is not necessarily performed by such a synthesis method.

As the preferred examples of $V_1$ and $V_3$ when linked to $G_1$ and $G_2$, a carboxyl group, an alkoxyl group, an acylamino group, a carbamoyl group, a sulfonamido group, a sulfamoyl group, a hydroxyl group and an alkylthio group are exemplified, more preferably an acylamino group and a carbamoyl group.

It is preferred that $G_1$ is linked to $R_{11}$ and $G_2$ is linked to $R_{13}$ respectively and both $R_{11}$ and $R_{13}$ represent hydrogen atoms at that time.

CI represents an ion to neutralize electric charge. Whether a compound is a cation or an anion, or whether a compound has net ionic charge depends upon the substituent. Representative cations are an ammonium ion and an alkali metal ion, and anions may be either inorganic ions or organic ions.

The examples of cations include, e.g., a sodium ion, a potassium ion, a triethylammonium ion, a diethyl(i-propyl)-ammonium ion, a pyridinium ion and a 1-ethylpyridinium ion, and the examples of anions include, e.g., a halogen anion (e.g., a chlorine ion, a bromine ion, a fluorine ion, an iodine ion) a substituted arylsulfonic acid ion (e.g., aparatoluensulfonic acid ion), an alkylsulfuric acid ion (e.g., a methylsulfuric acid ion), a sulfuric acid ion, a perchloric acid ion, a tetrafluoroboric acid and an acetic acid ion.

y represents a number necessary to neutralize electric charge.

In the compounds represented by formula (1), (2) or (3), Dye 1 and Dye 2 preferably have the same structure.

In the compounds represented by formula (1), (2) or (3), the preferred examples of Dye 1 and Dye 2 are shown below but the present invention is not limited thereto. The structural formulae of the compounds according to the present invention shown below are only the limiting structures of many resonance structures, and the structure may be other structures which can be taken by resonance.

Preferred Examples of the Residues of Dye 1 and Dye 2

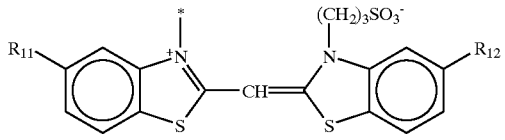

| | $R_{11}$ | $R_{12}$ |
|---|---|---|
| DA-1 | -Ph | —Cl |
| DA-2 | —Cl | —Cl |
| DA-3 | -Ph | -Ph |
| DA-4 | —Cl | —H |
| DA-5 | 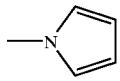 | —Cl |
| DA-6 | -Ph | —$SO_3Na$ |
| DA-7 | —Cl | —$SO_3Na$ |
| DA-8 | —$SO_3Na$ | —$SO_3Na$ |

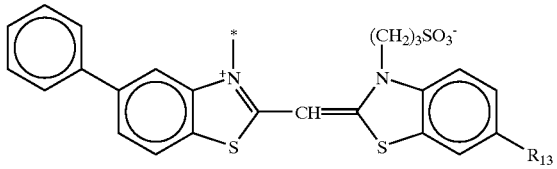

| | $R_{13}$ |
|---|---|
| DA-9 | —$SO_3Na$ |
| DA-10 | —COONa |

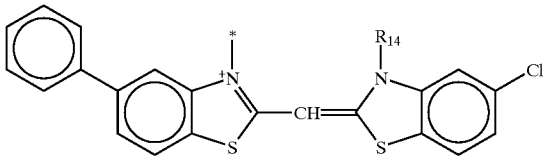

| | $R_{14}$ |
|---|---|
| DA-11 | —$(CH_2)_4SO_3^-$ |
| DA-12 | —$(CH_2)_2CH(CH_3)SO_3^-$ |
| DA-13 | —$C_2H_5$ |

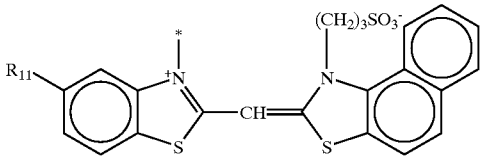

| | $R_{11}$ |
|---|---|

-continued
| | |
|---|---|
| DA-14 | —$SO_3Na$ |
| DA-15 | —COONa |
| DA-16 | —Cl |
| DA-17 | —$OCH_3$ |
DA-18
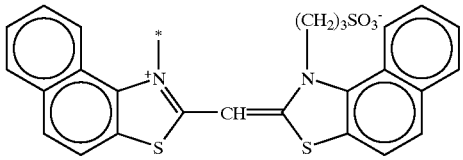
DA-19
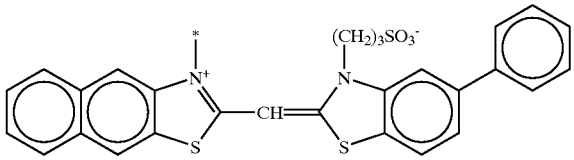
DA-20
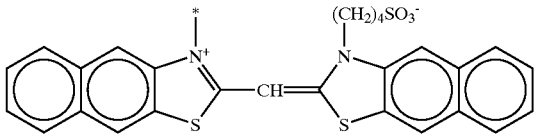
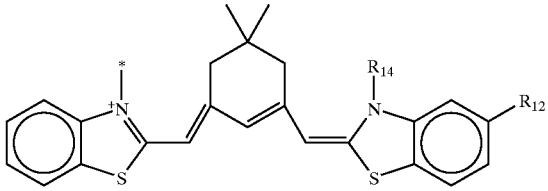
| | $R_{12}$ | $R_{14}$ |
|---|---|---|
| DA-21 | H | —$C_2H_5$ |
| DA-22 | H | —$(CH_2)_3SO_3^-$ |
| DA-23 | —$SO_3Na$ | —$(CH_2)_3SO_3^-$ |
DA-24
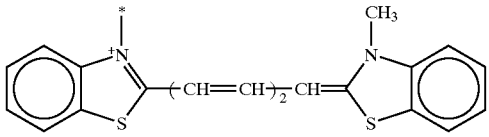
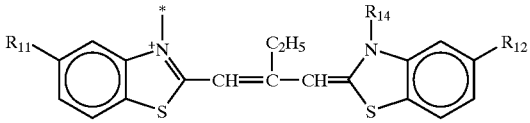
| | $R_{11}$ | $R_{12}$ | $R_{14}$ |
|---|---|---|---|
| DA-25 | —Cl | —Cl | —$(CH_2)_3SO_3^-$ |
| DA-26 | —Cl | —$SO_3Na$ | —$(CH_2)_3SO_3^-$ |
-continued
| | | | |
|---|---|---|---|
| DA-27 | —$CH_3$ | —$CH_3$ | —$(CH_2)_3SO_3^-$ |
| DA-28 | —Cl | —Cl | —$CH_2CH(OH)CH_2SO_3^-$ |
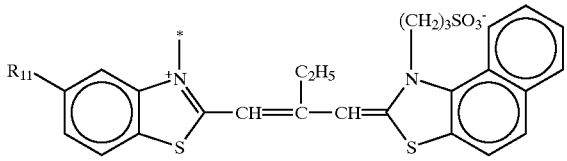
| | $R_{11}$ |
|---|---|
| DA-29 | —Cl |
| DA-30 | —$SO_3^-.H^+NEt_3$ |
| DA-31 | —COOH |
| DA-32 | —$C_4H_9$-t |
DA-33
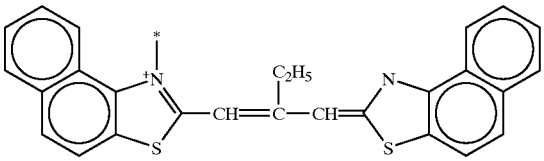
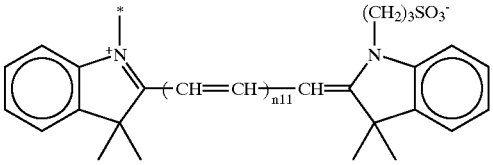
| | $n_{11}$ |
|---|---|
| DA-34 | 1 |
| DA-35 | 2 |
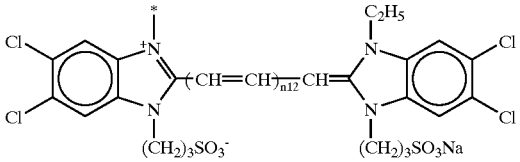
| | $n_{12}$ |
|---|---|
| DA-36 | 0 |
| DA-37 | 1 |
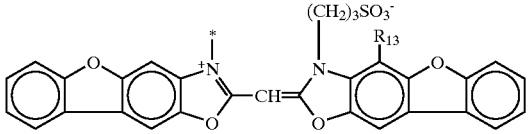
| | $R_{13}$ |
|---|---|
| DA-38 | H |
| DA-39 | —$SO_3Na$ |

-continued
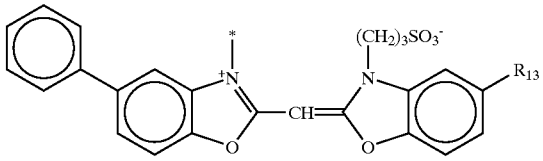
$R_{13}$
| | |
|---|---|
| DA-40 | —Cl |
| DA-41 | —$SO_3K$ |
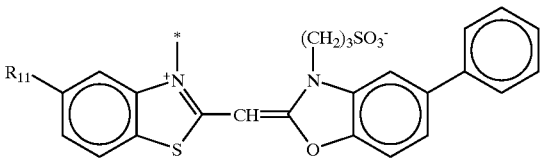
$R_{11}$
| | |
|---|---|
| DA-42 | —Cl |
| DA-43 | —$SO_3Na$ |
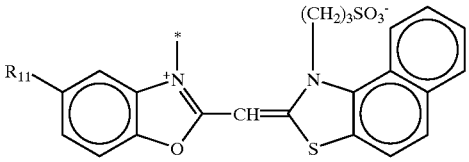
$R_{11}$
| | |
|---|---|
| DA-44 | —Cl |
| DA-45 | —$SO_3Na$ |
DA-46
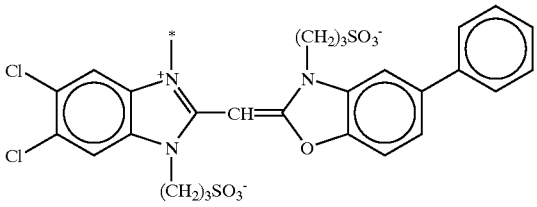
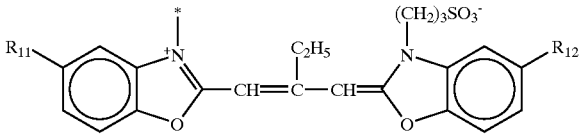
| | $R_{11}$ | $R_{12}$ |
|---|---|---|
| DA-47 | —Br | —Br |
| DA-48 | —Br | —$SO_3Na$ |
| DA-49 | -Ph | —Cl |
| DA-50 | —$SO_3Na$ | —$SO_3Na$ |
| DA-51 | —Cl | —Cl |
| DA-52 | —Cl | —COONa |
| DA-53 | -Ph | -Ph |
-continued
DA-54
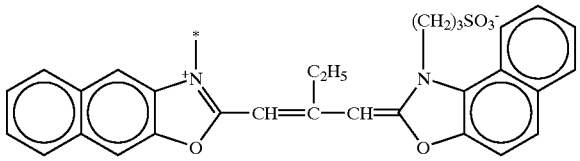
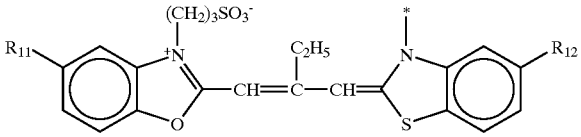
| | $R_{11}$ | $R_{12}$ |
|---|---|---|
| DA-55 | —Cl | —Cl |
| DA-56 | —$SO_3Na$ | —Cl |
| DA-57 | -Ph | —$CH_3$ |
| DA-58 | -Ph | —$SO_3Na$ |
| DA-59 | —$OCH_3$ | —$OCH_3$ |
DA-60
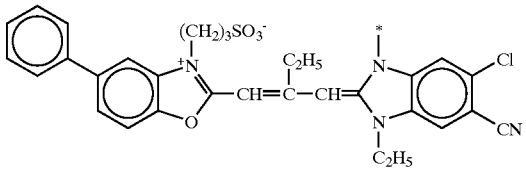
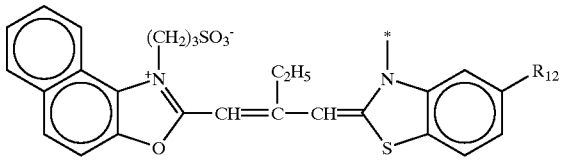
$R_{12}$
| | |
|---|---|
| DA-61 | —Cl |
| DA-62 | —$SO_3Na$ |
DA-63
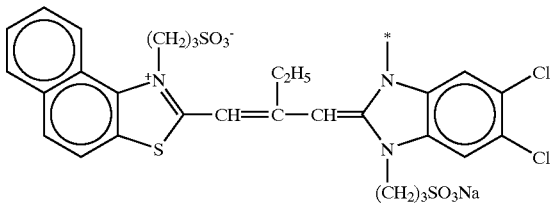
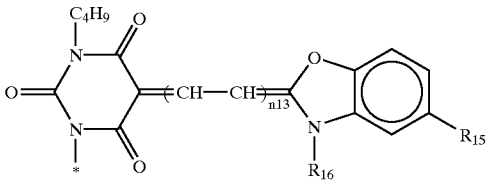
| | $n_{13}$ | $R_{15}$ | $R_{16}$ |
|---|---|---|---|
| DA-64 | 1 | —$SO_3Na$ | —$C_2H_5$ |
| DA-65 | 1 | —$SO_3Na$ | —$SO_3Na$ |
| DA-66 | 1 | H | —$SO_3K$ |
| DA-67 | 1 | H | —$C_2H_5$ |
| DA-68 | 2 | —$SO_3Na$ | —$C_2H_5$ |

-continued

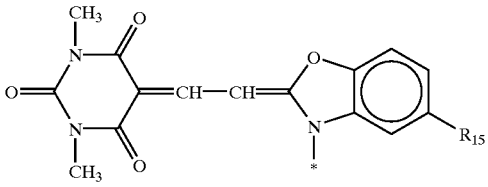

| | $R_{15}$ |
|---|---|
| DA-69 | $—SO_3Na$ |
| DA-70 | H |

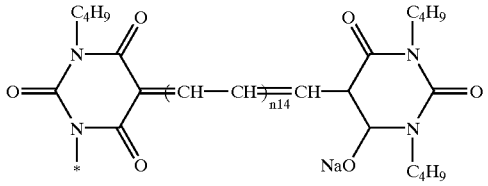

| | $n_{14}$ |
|---|---|
| DA-71 | 0 |
| DA-72 | 1 |
| DA-73 | 2 |

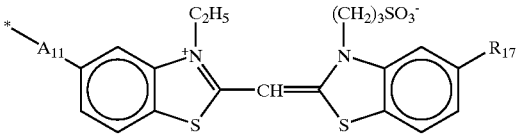

| | $A_{11}$ | $R_{17}$ |
|---|---|---|
| DA-74 | —O— | -Ph |
| DA-75 | —OC(=O)— | " |
| DA-76 | —NHCO— | " |
| DA-77 | $—NHSO_2—$ | " |
| DA-78 | —CONH— | " |
| DA-79 | $—SO_2NH—$ | " |
| DA-80 | —NHCO— | —Cl |

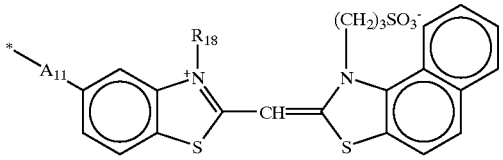

| | $A_{11}$ | $R_{18}$ |
|---|---|---|
| DA-81 | —NHCO— | $—C_2H_5$ |
| DA-82 | —CONH— | " |
| DA-83 | —NHCO— | $—SO_3Na$ |

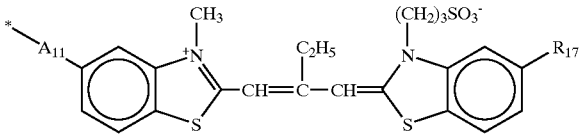

| | $A_{11}$ | $R_{17}$ |
|---|---|---|
| DA-84 | —NHCO— | $—SO_3Na—$ |
| DA-85 | —CONH— | —Cl |

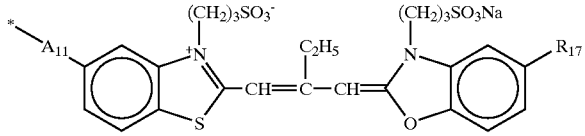

| | $A_{11}$ | $R_{17}$ |
|---|---|---|
| DA-86 | —NHCO— | —Br |
| DA-87 | —CONH— | —Cl |

In the compounds represented by formula (1) or (2), the preferred examples of the linking groups $-L_1-(R_1)_{m3}$ are shown below but the present invention is not limited thereto.

Examples of Linking Groups $-L_1-(R_1)_{m3}$ (the left side is Dye 1)

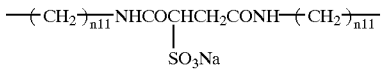

| | $n_{11}$ |
|---|---|
| L-1 | 3 |
| L-2 | 4 |
| L-3 | 8 |

L-4

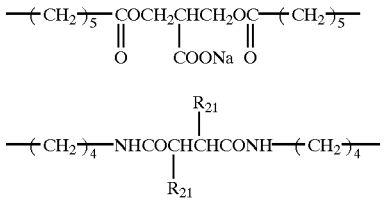

| | $R_{21}$ |
|---|---|
| L-5 | $—OSO_3^-.H^+NEt_3$ |
| L-6 | $—OPO_3Na_2$ |

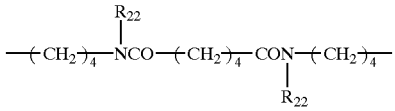

| | $R_{21}$ |
|---|---|
| L-7 | $—(CH_2)_3SO_3Na$ |
| L-8 | $—(CH_2)_2COOH$ |
| L-9 | $—(CH_2)_2PO_3Na_2$ |

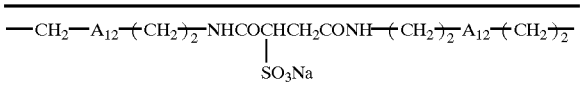

| | $A_{12}$ |
|---|---|
| L-10 | $—SO_2—$ |

-continued

| | |
|---|---|
| L-11 | —O— |
| L-12 | 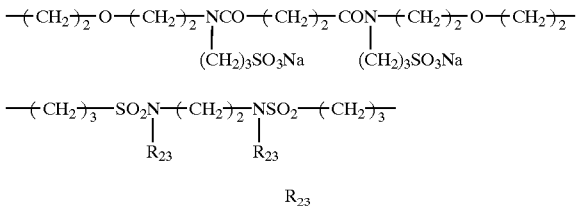 |
| | $R_{23}$ |
| L-13 | $-(CH_2)_3-SO_3Na$ |
| L-14 | $-(CH_2)_6-COONa$ |
| L-15 | 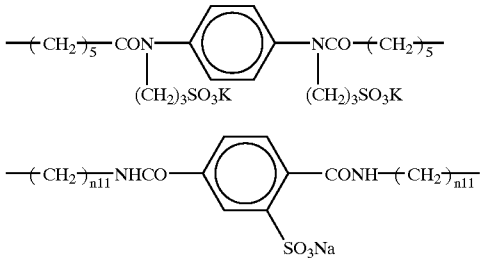 |
| | $n_{11}$ |
| L-16 | 3 |
| L-17 | 4 |
| L-18 | 8 |

The specific examples of the compounds represented by formula (1) or (2) according to the present invention are shown below but the present invention is not limited thereto.

Specific Examples of the Compound Dye

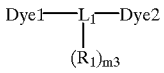

of the Present Invention

| | Dye1 | $-L_1-(R_1)_{m_3}-$ | Dye2 |
|---|---|---|---|
| D-1 | DA-1 | L-2 | DA-1 |
| D-2 | DA-2 | " | DA-2 |
| D-3 | DA-6 | " | DA-6 |
| D-4 | DA-1 | " | " |
| D-5 | DA-10 | L-3 | DA-10 |
| D-6 | DA-14 | L-2 | DA-14 |
| D-7 | DA-16 | " | DA-16 |
| D-8 | DA-16 | " | DA-14 |
| D-9 | DA-26 | L-3 | DA-26 |
| D-10 | DA-28 | L-2 | DA-28 |
| D-11 | DA-37 | " | DA-37 |
| D-12 | DA-39 | " | DA-39 |
| D-13 | DA-42 | L-8 | DA-42 |
| D-14 | DA-44 | L-9 | DA-44 |
| D-15 | DA-47 | L-2 | DA-47 |
| D-16 | DA-49 | " | DA-49 |
| D-17 | DA-54 | " | DA-50 |
| D-18 | DA-64 | " | DA-64 |
| D-19 | DA-72 | " | DA-72 |
| D-20 | DA-1 | L-6 | DA-1 |
| D-21 | " | L-7 | " |
| D-22 | DA-16 | " | DA-16 |
| D-23 | DA-2 | L-11 | DA-2 |
| D-24 | DA-54 | L-12 | DA-54 |
| D-25 | DA-1 | L-13 | DA-1 |
| D-26 | DA-55 | L-7 | DA-55 |
| D-27 | DA-49 | L-2 | DA-6 |
| D-28 | DA-54 | " | DA-68 |
| D-29 | DA-50 | " | DA-65 |
| D-30 | D-1 | L-2 | D-64 |
| D-31 | " | " | D-65 |
| D-32 | " | L-7 | D-64 |
| D-33 | " | " | D-65 |
| D-34 | " | L-11 | D-64 |
| D-35 | " | L-12 | " |
| D-36 | DA-76 | L-2 | DA-76 |
| D-37 | " | L-7 | " |
| D-38 | " | L-11 | " |
| D-39 | " | L-12 | " |
| D-40 | DA-78 | L-2 | DA-78 |
| D-41 | DA-81 | " | DA-81 |
| D-42 | DA-82 | L-7 | DA-82 |
| D-43 | DA-1 | L-15 | DA-1 |
| D-44 | DA-16 | " | DA-16 |
| D-45 | DA-1 | L-17 | DA-1 |
| D-46 | DA-16 | " | DA-16 |
| D-47 | DA-1 | L-2 | DA-8 |

In the compounds represented by formula (1) or (3), the preferred examples of the linking groups $-L_1-(R_1)_{m3}$ are shown below, but the present invention is not limited thereto.

Examples of Linking Groups $-L_1-(R_1)_{m3}$ (the left side is Dye 1)

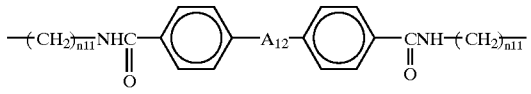

| | $n_{11}$ | $A_{12}$ |
|---|---|---|
| L'-1 | 4 | — |
| L'-2 | 4 | —O— |
| L'-3 | 4 | $—SO_2—$ |

-continued
| | | |
|---|---|---|
| L'-4 | 4 | 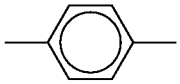 |
| L'-5 | 2 | — |
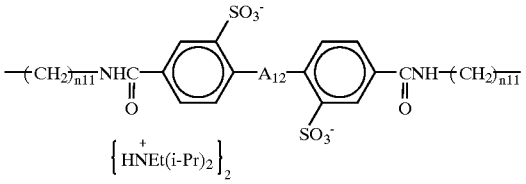
| | $n_{11}$ | $A_{12}$ |
|---|---|---|
| L'-6 | 4 | — |
| L'-7 | 1 | — |
| L'-8 | 3 | —O— |
| L'-9 | 3 | —$SO_3$— |
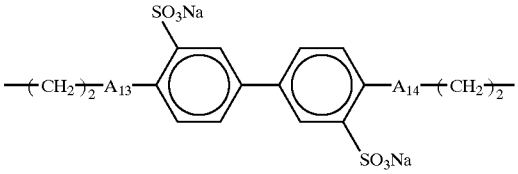
| | $A_{13}$ | $A_{14}$ |
|---|---|---|
| L'-10 | —O— | —O— |
| L'-11 | —OC(=O)— | —CO(=O)— |
| L'-12 | —CO(=O)— | —OC(=O)— |
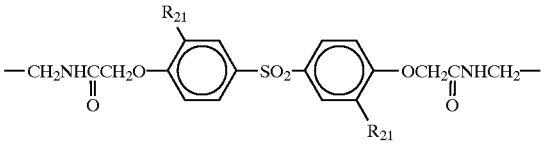
| | $R_{21}$ |
|---|---|
| L'-13 | H |
| L'-14 | —$SO_3Na$ |
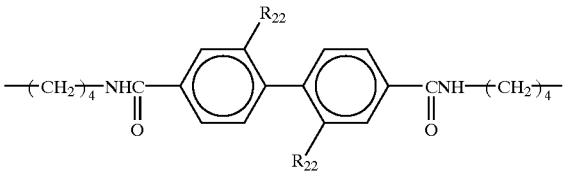
| | $R_{22}$ |
|---|---|
| L'-15 | —$OPO_3Na_2$ |
| L'-16 | —$PO_3Na_2$ |
| L'-17 | —COONa |
| L'-18 | —$OSO_3Na$ |

-continued
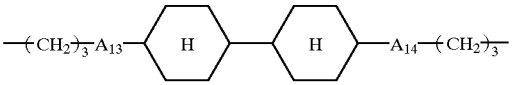
| | $A_{13}$ | $A_{14}$ |
|---|---|---|
| L'-19 | —NHCO— | —CONH— |
| L'-20 | —CO—<br>‖<br>O | —OC—<br>‖<br>O |
L'–21
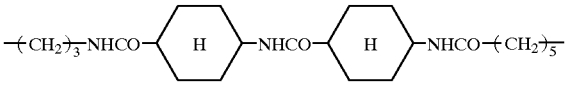
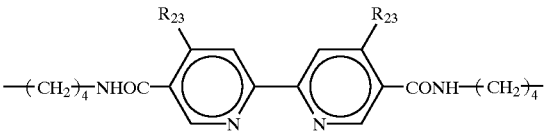
| | $R_{23}$ |
|---|---|
| L'-22 | H |
| L'-23 | —COONa |
L'–24
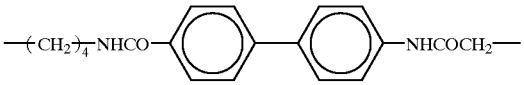
L'–25
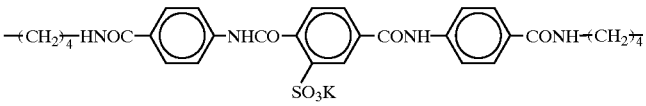
L'–26
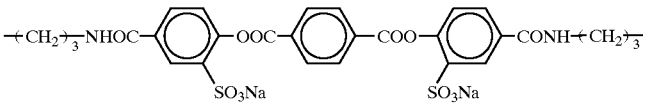
L'–27
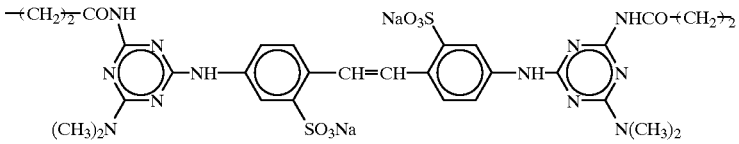
L'–28
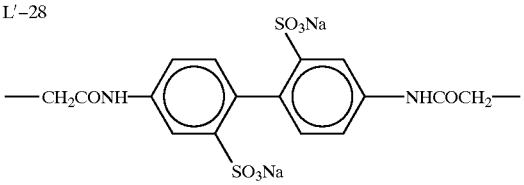

The specific examples of the compounds represented by formula (1) or (3) according to the present invention are shown below but the present invention is not limited thereto.

Specific Examples of the Compound

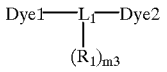

of the Present Invention

| | Dye1 | $—L_1-(R_1)_{m_3}—$ | Dye2 |
|---|---|---|---|
| D'-1 | DA-1 | L'-1 | DA-1 |
| D'-2 | DA-2 | " | DA-2 |
| D'-3 | DA-6 | " | DA-6 |
| D'-4 | DA-26 | " | DA-26 |
| D'-5 | DA-1 | L'-2 | DA-1 |
| D'-6 | " | L'-3 | " |
| D'-7 | DA-6 | " | DA-6 |
| D'-8 | DA-1 | L'-6 | DA-1 |
| D'-9 | DA-2 | " | DA-2 |
| D'-10 | DA-1 | " | DA-6 |
| D'-11 | DA-16 | " | DA-16 |
| D'-12 | DA-16 | " | DA-14 |
| D'-13 | DA-28 | " | DA-28 |
| D'-14 | DA-37 | " | DA-37 |
| D'-15 | DA-39 | " | DA-39 |
| D'-16 | DA-42 | " | DA-42 |
| D'-17 | DA-44 | " | DA-44 |
| D'-18 | DA-54 | " | DA-50 |
| D'-19 | DA-54 | " | DA-54 |
| D'-20 | DA-47 | " | DA-47 |
| D'-21 | DA-49 | " | DA-50 |
| D'-22 | DA-55 | " | DA-55 |
| D'-23 | DA-64 | " | DA-64 |
| D'-24 | DA-54 | " | DA-64 |
| D'-25 | DA-72 | " | DA-72 |
| D'-26 | DA-1 | " | DA-64 |
| D'-27 | " | " | DA-65 |
| D'-28 | DA-49 | " | DA-72 |
| D'-29 | DA-1 | L'-12 | DA-1 |
| D'-30 | DA-1 | " | DA-64 |
| D'-31 | DA-1 | L'-14 | DA-1 |
| D'-32 | DA-16 | " | DA-16 |
| D'-33 | DA-47 | " | DA-47 |
| D'-34 | DA-1 | " | DA-64 |
| D'-35 | DA-1 | L'-19 | DA-1 |
| D'-36 | DA-1 | L'-26 | DA-1 |
| D'-37 | DA-16 | " | DA-16 |
| D'-38 | DA-1 | " | DA-64 |
| D'-39 | DA-76 | L'-6 | DA-76 |
| D'-40 | DA-78 | " | DA-78 |
| D'-41 | DA-81 | " | DA-81 |
| D'-42 | DA-76 | " | DA-76 |
| D'-43 | DA-1 | " | DA-8 |

The compound of the present invention can be synthesized according to the methods described in the following literature and patent.

F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Clause 14, pp. 482 to 515, John Wiley & Sons, New York, London (1977), and EP-A-887700.

In the compound represented by formula (1), it is preferred that the adsorptivity to a silver halide grain satisfies the relationship, Dye 1≧Dye 2>$L_1$-$(R_1)_{m3}$.

The adsorptivity to a silver halide grain can be determined by using each sample compound.

It is preferred that when Dye 2 of the compound represented by formula (1) is excited by light, Dye 2 can be transferred to Dye 1 by electron transfer or energy transfer.

Further, in a silver halide photographic emulsion and a silver halide photographic material, it is preferred that in the compound represented by formula (1), only one chromophore of Dye 1 or Dye 2 is adsorbed onto a silver halide grain, and when the chromophore not adsorbed onto a silver halide grain is excited by light, the chromophore not adsorbed onto a silver halide grain is transferred to the chromophore adsorbed onto a silver halide grain by electron transfer or energy transfer.

In a silver halide photographic emulsion and a silver halide photographic material, it is preferred that in the compound represented by formula (1), only one chromophore of Dye 1 or Dye 2 is adsorbed onto a silver halide grain and forms J-association, and the chromophore which is not adsorbed onto a silver halide grain also forms J-association.

The silver halide photographic material according to the present invention will be described in detail below.

The compound according to the present invention is primarily used as sensitizing dyes in a silver halide photographic emulsion and a silver halide photographic material.

The compounds according to the present invention can be used alone, in combination, or in combination with sensitizing dyes other than the dyes of the present invention. As the dyes to be used in combination, e.g., a cyanine dye, a merocyanine dye, a rhodacyanine dye, a trinuclear merocyanine dye, a tetranuclear merocyanine dye, an allopolar dye, a hemicyanine dye and a styryl dye are preferably used, a cyanine dye, a merocyanine dye and a rhodacyanine dye are more preferably used, and a cyanine dye is particularly preferably used. These dyes are described in detail in F. M. Harmer, *Heterocyclic Compounds—Cyanine Dyes and Related Compounds,* John Wiley & Sons, New York, London (1964), and D. M. Sturmer, *Heterocyclic Compounds—Special Topics in Heterocyclic Chemistry,* Chap. 18, Clause 14, pp. 482 to 515.

The formulae and the sensitizing dyes shown by the specific examples disclosed on pages 32 to 44 in U.S. Pat. No. 5,994,051 and on pages 30 to 39 in U.S. Pat. No. 5,747,236 can be exemplified as the preferred dyes.

Further, formulae (XI), (XII) and (XIII), columns 21 and 22 in U.S. Pat. No. 5,340,694 can be exemplified as the preferred formulae of cyanine, merocyanine and rhodacyanine dyes, respectively (however, the numbers of $n_{12}$, $n_{15}$, $n_{17}$ and $n_{18}$ are not restricted here and regarded as the integers of 0 or more (preferably 4 or less)).

These sensitizing dyes may be used alone, or in combination of two or more kinds (for the purpose of supersensitization). The representative examples of combinations are disclosed in U.S. Pat. Nos. 2,688,545, 2,977,229, 3,397,060, 3,522,052, 3,527,641, 3,617,293, 3,628,964,3, 666,480, 3,672,898, 3,679,428, 3,303,377, 3,769,301, 3,814, 609, 3,837,862, 4,026,707, British Patents 1,344,281, 1,507, 803, JP-B-43-49336 (the term "JP-B" as used herein means an "examined Japanese patent publication") JP-B-53-12375, JP-A-52-110618 and JP-A-52-109925.

Dyes which themselves do not have a spectral sensitizing function or substances which substantially do not absorb visible light but show supersensitization can be incorporated into an emulsion with sensitizing dyes.

Useful supersensitizers for use in spectral sensitization in the present invention (e.g., pyrimidylamino compounds, triazinylamino compounds, azolium compounds, aminostyryl compounds, aromatic organic acid-formaldehyde condensed products, azaindene compounds, cadmium salts) and the combinations of supersensitizers with sensitizing dyes are disclosed, e.g., in U.S. Pat. Nos. 3,511,664, 3,615, 613, 3,615,632, 3,615,641, 4,596,767, 4,945,038, 4,965,182, 2,933,390, 3,635,721, 3,743,510, 3,617,295, and 3,635,721, and the using methods disclosed in these patents are also preferably used.

The time of the addition of the sensitizing dyes according to the present invention (and other sensitizing dyes and supersensitizers) to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Further, as disclosed in U.S. Pat. No. 4,225,666 and JP-A-58-7629, the sensitizing dyes can be used as a single compound alone or in combination with compounds having foreign structures, and they can be divided and added separately, for example, one part of them is added during grain formation stage and the remaining is added during chemical ripening or after the completion of chemical ripening, alternatively one part is added prior to chemical ripening or during chemical ripening stage and the remaining after completion of chemical ripening. The kinds of compounds added separately and combinations of compounds may be varied.

The addition amount of the sensitizing dyes according to the present invention (and other sensitizing dyes and supersensitizers) is varied in accordance with the shape and the size of silver halide grains, therefore, the addition amount is not restricted at all, but the dyes can be used preferably in an amount of from $1\times10^{-8}$ to $8\times10^{-1}$ mol per mol of the silver halide. For example, when the grain size of the silver halide grains is from 0.2 to 1.3 $\mu$m, the addition amount is preferably from $2\times10^{-6}$ to $3.5\times10^{-3}$ mol and more preferably from $7.5\times10^{-6}$ to $1.5\times10^{-3}$ mol per mol of the silver halide.

The sensitizing dyes according to the present invention (and other sensitizing dyes and supersensitizers) can be directly dispersed in an emulsion. Alternatively, the sensitizing dyes may be dissolved in an appropriate solvent, e.g., methyl alcohol, ethyl alcohol, methyl cellosolve, acetone, water, pyridine, or mixtures of these solvents, and added to an emulsion as a solution. At this time, additives such as bases, acids, surfactants, etc., can be added together. Further, ultrasonic waves can also be used for dissolution. For adding the sensitizing dyes, a method of dissolving the sensitizing dyes in a volatile organic solvent, dispersing the solution in a hydrophilic colloid and adding this dispersion to an emulsion as disclosed in U.S. Pat. No. 3,469,987, a method of dispersing the sensitizing dyes in a water-soluble solvent and adding the dispersion to an emulsion as disclosed in JP-B-46-24185, a method of dissolving the sensitizing dyes in a surfactant and adding the solution to an emulsion as disclosed in U.S. Pat. No. 3,822,135, a method of dissolving the sensitizing dyes using a compound capable of red-shifting and adding the solution to an emulsion as disclosed in JP-A-51-74624, and a method of dissolving the sensitizing dyes in an acid not substantially containing water and adding the solution to an emulsion as disclosed in JP-A-50-80826 can be used. Besides the above methods, the methods disclosed in U.S. Pat. Nos. 2,912,343, 3,342,605, 2,996,287 and 3,429,835 can also be used for the addition of the sensitizing dyes to an emulsion.

Any of silver bromide, silver iodobromide, silver chlorobromide, silver iodide, silver iodochloride, silver iodobromochloride and silver chloride can be used as the silver halide in a photographic emulsion concerning the light-sensitive mechanism according to the present invention. The iodide content in the outermost surface of the emulsion of 0.1 mol % or more, preferably 1 mol % or more, and particularly preferably 5 mol % or more contributes to the constitution of the stronger multilayer adsorption structure.

The grain size distribution may be broad or narrow but is preferably narrow.

The silver halide grains contained in a photographic emulsion may have a regular crystal form, such as cubic, octahedral, tetradecahedral, or rhombic dodecahedral, an irregular crystal form, such as spherical or plate-like, hkl planes, or a composite form of these crystal forms, but the silver halide grains according to the present invention are preferably tabular grains. Tabular grains are described in detail below. With respect to the silver halide grains having hkl planes, *Journal of Imaging Science,* Vol. 30, pp. 247 to 254 (1986) can be referred to.

The above-described silver halide grains may be used in the silver halide photographic emulsion according to the present invention alone or in combination of two or more. The interiors and the surfaces of the silver halide grains may be composed of different phases, the silver halide grains may be composed of multi-phase structures having junction structures, may have local phases on the surfaces, the grains may be composed of uniform phases, or may be composed of the mixtures of these grains.

The emulsions may be of the surface latent image type wherein the latent image is mainly formed on the surface, or of the internal latent image type wherein the latent image is formed within the grains.

In the present invention, tabular silver halide grains having halogen composition comprising silver chloride, silver bromide, silver chlorobromide, silver iodobromide, silver chloroiodobromide or silver iodochloride are preferably used. The tabular grains having {100} or {111} main surfaces are preferably used. Tabular grains having {111} main surfaces (hereinafter referred to as {111} tabular grains) have generally triangular or hexagonal planes. In general, the more uniform the grain size distribution, the higher is the ratio of tabular grains having hexagonal planes. Hexagonal monodispersed tabular grains are disclosed in JP-B-5-61205.

Tabular grains having {100} main surfaces (hereinafter referred to as {100} tabular grains) have rectangular or square shapes. In this emulsion, from acicular grains to grains having a ratio of adjacent side lengths of less than 5/1 are called tabular grains. In silver chloride tabular grains or high silver chloride content tabular grains, {100} tabular grains are originally high in main surface stability as compared with {111} tabular grains. With {111} tabular grains, it is essential to stabilize {111} main surface, and JP-A-9-80660, JP-A-9-80656 and U.S. Pat. No. 5,298,388 can be referred to with respect to the methods of the stabilization of main surface.

Silver chloride {111} tabular grains or high silver chloride content {111} tabular grains for use in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains which are used in the present invention are disclosed in U.S. Pat. Nos. 4,425,425, 4,425,426, 4,434,226, 4,439,520, 4,414,310, 4,433,048, 4,647,528, 4,665,012, 4,672,027, 4,678,745, 4, 684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

The silver halide emulsions for use in the present invention are preferably tabular silver halide grains adsorbed with the sensitizing dyes of the present invention and having higher surface area/volume ratio. The aspect ratio of the silver halide emulsions of the present invention is 2 or more (preferably 1,000 or less) preferably from 5 to 800, and more preferably from 8 to 500. The tabular grains preferably have a thickness of less than 0.2 $\mu$M, more preferably less than 0.1 $\mu$m, and still more preferably less than 0.07 $\mu$m.

The terminology "the aspect ratio is from 2 to 1,000" means that silver halide grain shaving an aspect ratio (equivalent-circle diameter/thickness of a silver halide grain) of from 2 to 1,000 account for 50% or more of the projected area of the entire silver halide grains in the emulsion, preferably 70% or more, and particularly preferably 85% or more.

For producing thin tabular grains having such a high aspect ratio, the following techniques are applicable.

The dislocation line distribution among grains of the tabular grains according to the present invention is preferably uniform. In the emulsion of the present invention, it is preferred that the silver halide grain having ten or more dislocation lines per one grain accounts for from 50 to 100% (number) of the entire grains, more preferably from 70 to 100%, and particularly preferably from 90 to 100%. If the percentage is less than 50%, it is not preferred in view of the uniformity among grains.

For finding the ratio of the grains having dislocation lines and the number of dislocation lines, it is preferred to directly observe at least 100 grains, more preferably 200 grains or more, and particularly preferably 300 grains or more.

Gelatin is preferably used as a protective colloid for producing the emulsions of the present invention and as a binder for other hydrophilic colloid layers, but other hydrophilic colloids can also be used.

For example, proteins such as gelatin derivatives, graft polymers of gelatin and other high polymers, albumin and casein; sugar derivatives such as cellulose derivatives, e.g., hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole can be used.

Acid-processed gelatin and enzyme-processed gelatin described in *Bull. Soc. Sci. Photo. Japan,* No. 16, p. 30 (1966) can be used as well as lime-processed gelatin, and hydrolyzed product and enzyme decomposed product of gelatin can also be used.

The silver halide emulsions for use in the present invention are preferably washed with water for the purpose of desalting and dispersed in a newly prepared protective colloid. The washing temperature can be selected according to the purpose but is preferably from 5 to 50° C. The pH at washing time can also be selected according to the purpose but is preferably from 2 to 10, more preferably from 3 to 8. The pAg at washing time can also be selected according to the purpose but is preferably from 5 to 10. The washing method can be selected from among a noodle washing method, a dialysis method using a semi-permeable membrane, a centrifugal separation method, a coagulation precipitation method, and an ion exchange method. In the case of a coagulation precipitation method, the washing method can be selected from among a method using sulfate, a method using an organic solvent, a method using a water-soluble polymer, a method using a gelatin derivative, etc.

It is preferred according to purpose for the silver halide emulsion grains for use in the present invention to contain metal ion salts during preparation of the emulsion, e.g., at the time of grain formation, during desalting process, during chemical sensitization or before coating. When grains are doped, metal ion salts are preferably added during grain formation, and when the surfaces of grains are modified or when metal ion salts are used as the chemical sensitizers, they are preferably added after grain formation and before completion of chemical sensitization. A method of doping can be selected such that a grain is entirely doped, only a core part of the grain is doped, or only a shell part is doped. Examples of the metals which can be used include, e.g., Mg, Ca, Sr, Ba, A1, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi, etc. These metals can be added in the form of a salt capable of being dissolved at the time of grain formation, e.g., ammonium salt, acetate, nitrate, sulfate, phosphate, hydroxide, or a six-coordinated complex salt or a four-coordinated complex salt, e.g., $CdBr_2$, $CdCl_2$, $Cd(NO_3)2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$, etc. can be exemplified. The ligands of coordination compounds can be selected from halo, aquo, cyano, cyanate, thiocyanate, nitrosyl, thionitrosyl, oxo and carbonyl. They may be comprised of only one kind of a metal compound or may be comprised of two, three or more metal compounds in combination.

Metal compounds are preferably dissolved in water or an appropriate solvent such as methanol or acetone. For stabilizing the solution, a method of adding an aqueous solution of hydrogen halide (e.g., HCl, HBr) or an alkali halide (e.g., KCl, $NaC_1$, KBr, NaBr) to the solution can be used. If desired, an acid or an alkali may be added. Metal compounds can be added to a reaction vessel before grain formation or may be added during grain formation. Metal compounds can also be added to a water-soluble silver salt (e.g., $AgNO_3$) or an aqueous solution of alkali halide (e.g., NaCl, KBr, Kl) and the solution may be added to the reaction solution continuously during silver halide grain formation. Alternatively, metal compounds may be added as a separate solution independently from a water-soluble silver salt or an aqueous solution of alkali halide and added continuously at a proper time during grain formation. It is also preferred to use various addition methods in combination.

As disclosed in U.S. Pat. No. 3,772,031, there are cases where a method in which the chalcogenide compounds are added during the emulsion formation is useful. Cyan salt, thiocyan salt, selenocyanic acid, carbonate, phosphate and acetate can be contained as well as S, Se and Te.

The silver halide grains according to the present invention can be subjected to at least one of sulfur sensitization, selenium sensitization, gold sensitization, palladium sensitization, noble metal sensitization and reduction sensitization during arbitrary stage of the production of silver halide emulsion.

It is preferred to combine two or more sensitizing methods. Various types of emulsions can be prepared depending upon the stages when the chemical sensitization is performed. There are a type in which a chemically sensitized speck is buried in the internal part of a grain, a type in which a chemically sensitized speck is buried in the shallow part from the surface of a grain, or a type in which a chemically sensitized speck is formed on the surface of a grain. The emulsion of the present invention can select the place of a chemically sensitized speck according to the purpose, but it is generally preferred to have at least one chemically sensitized speck in the vicinity of the surface of a grain.

Chemical sensitizing methods which can be preferably performed in the present invention are chalcogenide sensitization and noble metal sensitization alone or in combination, and these sensitizing methods can be performed using active gelatin as disclosed in T. H. James, *The Theory of the Photographic Process,* 4th Ed., pp. 67 to 76, Macmillan (1977), and also sensitization can be performed using sulfur, selenium, tellurium, gold, platinum, palladium, or iridium, or two or more of these sensitizers in combination at pAg of from 5 to 10, pH of from 5 to 8, and temperature of from 30 to 80° C. as disclosed in *Research Disclosure,* Vol. 120 (April, 1974), 12008, idib., Vol. 34 (June, 1975), 13452, U.S. Pat. Nos. 2,642,361, 3,297,446, 3,772,031, 3,857,711, 3,901,714, 4,266,018, 3,904,415 and British Patent 1,315,755. In noble metal sensitization, a noble metal salt such as gold, platinum, palladium and iridium can be used, and gold sensitization, palladium sensitization, and the combination of them are particularly preferred. In gold sensitization, well-known compounds such as chloroauric acid, potassium chloroaurate, potassium aurithiocyanate, gold sulfide and gold selenide can be used. The palladium compound means 2-equivalent or 4-equivalent salt of palladium. Preferred palladium compound is represented by $R_2PdX_6$ or $R_2PdX_4$, wherein R represents a hydrogen atom, an alkali metal atom or an ammonium group, and X represents a halogen atom, e.g., a chlorine, bromine or iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. A gold compound and a palladium compound are preferably used in combination with thiocyanate or selenocyanate.

Hypo, thiourea-based compounds, rhodanine-based compounds, and the sulfur-containing compounds disclosed in U.S. Pat. Nos. 3,857,711, 4,266,018 and 4,054,457 can be used as sulfur sensitizers. Chemical sensitization can be performed in the presence of a so-called auxiliary chemical sensitizer (i.e., a chemical sensitizing aid). The compounds known to inhibit fogging during chemical sensitization and to increase sensitivity such as azaindene, azapyridazine, azapyrimidine are used as the useful auxiliary chemical sensitizer. Examples of auxiliary chemical sensitizer modifier are disclosed in U.S. Pat. Nos. 2,131,038, 3,411,914, 3,554,757, JP-A-58-126526 and the above described G. F. Duffin, *Photographic Emulsion Chemistry*, pp. 138 to 143.

The emulsion according to the present invention is preferably subjected to gold sensitization in combination. The preferred amount of a gold sensitizer is from $1\times10^{-4}$ to $1\times10^{-7}$, more preferably from $1\times10^{-5}$ to $5\times10^{-7}$, per mol of the silver halide. The preferred amount of a palladium compound is from $1\times10^{-3}$ to $5\times10^{-7}$. The preferred amount of a thiocyan compound or a selenocyan compound is from $5\times10^{-2}$ to $1\times10^{-6}$.

The preferred amount of a sulfur sensitizer for use in the silver halide grains according to the present invention is from $1\times10^{-4}$ to $1\times10^{-7}$, more preferably from $1\times10^{-5}$ to $5\times10^{-7}$, per mol of the silver halide.

The emulsion of the present invention is preferably sensitized by a selenium sensitizing method. Well-known unstable selenium compounds are used in selenium sensitization. Specific examples of the unstable selenium compounds include selenium compounds such as colloidal metal selenium, selenoureas (e.g., N,N-dimethylselenourea, N,N-diethylselenourea), seleno ketones and selenoamides. Selenium sensitization is sometimes preferred to be used rather in combination with sulfur sensitization or noble metal sensitization or both of them.

The silver halide emulsion according to the present invention is preferably reduction sensitized during grain formation, after grain formation and before or during chemical sensitization, or after chemical sensitization.

The method of the reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, ascorbic acid and derivatives thereof amines and polyamines, hydrazine derivatives, formamidinesulfinic acid, silane compounds and borane compounds are well known as reduction sensitizers. These well-known reduction sensitizers can be used selectively in the present invention, and two or more of these compounds can also be used in combination. Stannous chloride, thiourea dioxide, dimethylamineborane, ascorbic acid and derivatives thereof are preferred compounds as the reduction sensitizer. Since the addition amount of the reduction sensitizer depends upon the production conditions of the emulsion, the addition amount needs to be selected, but from $10^{-7}$ to $10^{-3}$ mol per mol of the silver halide is preferred.

The reduction sensitizers are dissolved in water or an organic solvent such as alcohols, glycols, ketones, esters or amides and then added to a reaction solution during grain growth. The reduction sensitizers may be added to a reaction vessel in advance, but it is preferred to add them in the appropriate stage of grain growth. Alternatively, the reduction sensitizers may be added in advance to an aqueous solution of water-soluble silver salt or an aqueous solution of water-soluble alkali halide and silver halide grains can be precipitated using these aqueous solutions. In addition, the solution of the reduction sensitizers may be divided to several parts and added in several times or may be added continuously over a long period of time with the degree of the grain growth.

It is preferred to use an oxidizing agent for silver during the production process of the emulsion of the present invention. The oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form sparingly water-soluble silver salt such as silver halide, silver sulfide or silver selenide, or may form easily water-soluble silver salt such as silver nitrate. An oxidizing agent for silver may be inorganic or organic. Examples of the inorganic oxidizing agents include oxyacid salt, such as ozone, hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), a halogen element such as iodine and bromine, perhalogen acid salt (e.g., potassium periodate), salt of metal of high valency (e.g., potassium hexacyanoferrate(III)), and thiosulfonate.

Further, examples of organic oxidizing agents include quinones such as p-quinone, organic peroxide such as peracetic acid and perbenzoic acid, compounds which release active halogen (e.g., N-bromosuccinimide, chloramine T, chloramine B).

The oxidizing agents which are preferably used in the present invention are inorganic oxidizing agents such as ozone, hydrogen peroxide and addition products thereof, a halogen element, thiosulfonate, and organic oxidizing agents such as quinones. It is preferred to use the above-described reduction sensitization in combination with oxidizing agents for silver. The method of usage can be selected from a method in which an oxidizing agent is used and then reduction sensitization is performed, an inverse method thereof, or a method in which both are concurred with. These methods can be used selectively in grain forming process and chemical sensitization process.

Various compounds can be added to the photographic emulsion of the present invention for preventing generation of fog or stabilizing photographic performances during production, storage or processing of the photographic material. The examples of such compounds include compounds well-known as an antifoggant or a stabilizer such as thiazoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole); mercaptopyrimidines; mercaptotriazines; thioketo compounds, e.g., oxazolinethione; azaindenes, e.g., triazaindenes, tetraazaindenes (in particular, 4-hydroxy-substituted-(1,3,3a,7)-tetraazaindene), and pentaazaindenes. For example, the compounds disclosed in U.S. Pat. Nos. 3,954,474, 3,982,947 and JP-B-52-28660 can be used. As one preferred compound, there is a compound disclosed in JP-A-63-212932. Antifoggants and stabilizers can be used in various processing steps of emulsion production according to purpose, e.g., before grain formation, during grain formation, after grain formation, during washing, at the time of dispersion after washing, before chemical sensitization, during chemical sensitization, after chemical sensitization, and before coating. Antifoggants and stabilizers are added to a reaction solution during emulsion production to prevent fog from occurring and stabilize the emulsion, but they can be used for various other purposes besides these original functions, e.g., for controlling the crystal habit of a grain, for making a grain size small, for reducing the solubility of a grain, for controlling chemical sensitization, and for controlling the arrangement of dyes.

The silver halide emulsion produced according to the present invention can be used in color photographic materials and black-and-white photographic materials. As color photographic materials, in particular, color photographic papers, color films for photographing, color reversal films and color diffusion transfer films, and as black-and-white photographic materials, general films for photographing, X-ray films, films for medical diagnosis, photographic films for printing and diffusion transfer films can be exemplified.

In the fields of films for medical diagnosis and photographic films for printing, laser image setters and laser imagers can be effectively used for exposure.

The techniques in these fields are disclosed in JP-A-7-287337, JP-A-4-335342, JP-A-5-313289, JP-A-8-122954 and JP-A-8-292512.

The present invention can also be applied to photothermographic materials. For example, photothermographic materials having a light-sensitive layer having dispersed in a binder matrix a catalytically active amount of a photocatalyst (e.g., a silver halide), a reducing agent, a reducible silver salt (e.g., an organic silver salt) and, if necessary, a toner for adjusting the tone of silver are known.

These heat developing photographic materials are disclosed, e.g., in U.S. Pat. Nos. 3,152,904, 3,457,075, 2,910,377, 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and Japanese Patent Application No. 2000-89436.

The compound according to the present invention can also be preferably applied to diffusion transfer photographic materials. Of these materials, with respect to a heat developing diffusion transfer system, the methods disclosed in JP-A-2000-98562 (wherein pre-formed dyes are used) and Japanese Patent Application No. 2000-89436 (wherein dyes formed by coupling are used) can be referred to, and with respect to an instant photographic system, JP-A-2000-284442 can be referred to.

The disclosures on line 36, column 63 to line 2, column 65 in JP-A-10-239789 can be applied to the preparation method of the photographic emulsion for use in the present invention.

The disclosures on line 3, column 65 to line 13, column 73 in JP-A-10-239789 can be applied to additives such as color couplers, additives to photographic materials, the kind of the photographic materials to which the present invention can be applied and processing of photographic materials.

The above-described various additives are used in the photographic material according to the present invention but various other additives can be used according to purposes besides the above-described compounds.

These additives are described in detail in *Research Disclosure, Item* 17643 (December, 1978), ibid., Item 18716 (November, 1979) and ibid., Item 308119 (December, 1989). The locations corresponding thereto are indicated in the table below.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | — | page 648, right column | — |
| 3. Spectral Sensitizers | pages 23–24 | page 648, right column | page 996, right column |

-continued

| Type of Additives | RD 17643 | RD 18716 | RD 308119 |
|---|---|---|---|
| and Supersensitizers | | to page 649, right column | to page 998, right column |
| 4. Brightening Agents | page 24 | — | page 998, right column |
| 5. Antifoggants and Stabilizers | pages 24–25 | page 649, right column | page 998, right column to page 1000, right column |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, | page 650, left to right column | page 1002, right column |
| 8. Color image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left to right columns |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column to page 1009, left column |

The emulsion according to the present invention, and techniques such as layer arrangement, silver halide emulsions, functional couplers such as dye-forming couplers and DIR couplers, various additives and development processing which can be used in the photographic material using the emulsion according to the present invention are disclosed in EP-A-0565096 (disclosed on Oct. 13th, 1993) and the patents cited therein. Each item and corresponding locations are listed below.

| | | |
|---|---|---|
| 1. | Layer Structures | lines 23 to 35, page 61; line 41 page 61 to line 14, page 62 |
| 2. | Intermediate Layers | lines 36 to 40, page 61 |
| 3. | Interlayer Effect-Donating Layers | lines 15 to 18, page 62 |
| 4. | Halide Compositions of Silver Halide | lines 21 to 25, page 62 |
| 5. | Crystal Habits of Silver Halide Grains | lines 26 to 30, page 62 |
| 6. | Grain Sizes of Silver Halide Grains | lines 31 to 34, page 62 |
| 7. | Producing Methods of Emulsions | lines 35 to 40, page 62 |
| 8. | Grain Size Distributions of Silver Halide Grains | lines 41 and 42, page 62 |
| 9. | Tabular Grains | lines 43 to 46, page 62 |
| 10. | Structures of Interiors of Grains | lines 47 to 53, page 62 |
| 11. | Latent Image-Forming Types of Emulsions | line 54, page 62 to line 5, page 63 |
| 12. | Physical Ripening and Chemical Ripening of Emulsions | lines 6 to 9, page 63 |
| 13. | Mixed Use of Emulsions | lines 10 to 13, page 63 |
| 14. | Fogged Emulsions | lines 14 to 31, page 63 |
| 15. | Light-Insensitive Emulsions | lines 32 to 43, page 63 |
| 16. | Coating Amount of Silver | lines 49 and 50, page 63 |
| 17. | Formaldehyde Scavengers | lines 54 to 57, page 64 |
| 18. | Mercapto-Based Antifoggants | lines 1 and 2, page 65 |
| 19. | Releasing Agents of Antifoggants, etc. | lines 3 to 7, page 65 |
| 20. | Dyes | lines 7 to 10, page 65 |
| 21. | Color Couplers in General | lines 11 to 13, page 65 |

-continued

| | | |
|---|---|---|
| 22. | Yellow, Magenta and Cyan Couplers | lines 14 to 25, page 65 |
| 23. | Polymer Couplers | lines 26 to 28, page 65 |
| 24. | Diffusible Dye-Forming Couplers | lines 29 to 31, page 65 |
| 25. | Colored Couplers | lines 32 to 38, page 65 |
| 26. | Functional Couplers in General | lines 39 to 44, page 65 |
| 27. | Bleaching Accelerator-Releasing Couplers | lines 45 to 48, page 65 |
| 28. | Development Accelerator-Releasing Couplers | lines 49 to 53, page 65 |
| 29. | Other DIR Couplers | line 54, page 65 to line 4, page 66 |
| 30. | Methods of Coupler Dispersion | lines 5 to 28, page 66 |
| 31. | Antiseptics, Antibacterial Agents | lines 29 to 33, page 66 |
| 32. | Kinds of Photographic Materials | lines 34 to 36, page 66 |
| 33. | Film Thickness of Light-Sensitive Layer and Film Swelling Rate | line 40, page 66 to line 1, page 67 |
| 34. | Backing Layers | lines 3 to 8, page 67 |
| 35. | Development Processing in General | lines 9 to 11, page 67 |
| 36. | Developing Solutions and Developing Agents | lines 12 to 30, page 67 |
| 37. | Additives for Developing Solution | lines 31 to 44, page 67 |
| 38. | Reversal Process | lines 45 to 56, page 67 |
| 39. | Opening Rate of Processing Solutions | line 57, page 67 to line 12, page 68 |
| 40. | Developing Time | lines 13 to 15, page 68 |
| 41. | Blixing, Bleaching and Fixing | line 16, page 68 to line 31, page 69 |
| 42. | Automatic Processors | lines 32 to 40, page 69 |
| 43. | Washing, Rinsing and Stabilization | line 41, page 69 to line 18, page 70 |
| 44. | Replenishment of Processing Solutions and Reuse | lines 19 to 23, page 70 |
| 45. | Incorporation of Developers in Photographic Materials | lines 24 to 33, page 70 |
| 46. | Temperature of Development Processing | lines 34 to 38, page 70 |
| 47. | Use in Film Equipped with Lens | lines 39 to 41, page 70 |

The exposure method of the silver halide photographic materials of the present invention is described below. Photographic images can be obtained by ordinary exposure methods. That is, various well-known light sources, e.g., natural light (daylight), a tungsten lamp, a fluorescent lamp, a mercury lamp, a xenon arc lamp, a carbon arc lamp, a xenon flash lamp, a laser beam, LED, CRT, etc., can be used. Exposure may be performed by light released from phosphors excited by an electron beam, an x-ray, a γ-ray, an α-ray, etc.

Laser light sources are sometimes preferably used in the present invention. There are several kinds of laser beams, e.g., those making use of helium-neon gas, argon gas, krypton gas, and carbon dioxide gas as a laser oscillating medium, those using a solid, e.g., ruby and cadmium, as an oscillator, and a liquid laser and a semiconductor laser. As such laser beams are coherent lights having sharp directional property of uniform phase of single frequency different from general lights for illumination, etc., it is necessary for a silver halide photographic material to be exposed to have spectral characteristics coincident with the oscillating wavelength of the laser to be used as a light source.

Of the above lasers, a semiconductor laser is preferably used.

The compound according to the present invention can be used as various filter dyes, irradiation preventing dyes, and antihalation dyes for the purpose of improving sharpness and color separation property besides the sensitizing dyes.

The compound according to the present invention can be added to the coating solutions for a light-sensitive layer of a silver halide photographic material, a filter layer, and/or an antihalation layer by ordinary methods. The use amount of the dye should be sufficient to color photographic layers and those skilled in the art can easily select the amount according to use purposes. It is preferred in general to select the amount to give optical density of from 0.05 to 3.0. The dye may be added at any stage if it is before coating.

Further, the polymer having the counter charge to the ion of the dye may be contained in the same layer as a mordant to interact with the dye molecule, to thereby localize the dye in a specific layer.

The polymer mordants disclosed in U.S. Pat. Nos. 2,548,564, 4,124,386, 3,625,694, 3,958,995, 4,168,976 and 3,445,231 can be used in the present invention.

The compound according to the present invention can be added to desired layers, e.g., an intermediate layer, a protective layer and a backing layer in addition to a light-sensitive emulsion layer.

Further, the compound according to the present invention can be used in various non-silver salt image-forming methods as a photosensitizer (a photo-charge separator) or also can be used as a photocatalyst or a light-hydrogen generating agent.

In the present invention, light absorption strength means the light absorptive areal strength per a unit surface area of a grain by a sensitizing dye, and is defined as the value obtained by integrating optical density Log $[I_0/(I_0-I)]$ to wavelength ($cm^{-1}$), when the light amount to be incident on the unit surface area of a grain is taken as $I_0$ and the light amount to be absorbed by a sensitizing dye on the surface is taken as I. The coverage of integration is from 5,000 $cm^{-1}$ to 35,000 $cm^{-1}$.

It is preferred for the silver halide photographic emulsion according to the present invention to contain silver halide grains having the light absorption strength of 100 or more in the proportion of ½ or more of the entire projected area of silver halide grains when the spectral absorption maximum wavelength is 500 nm or more, and silver halide grains having the light absorption strength of 60 or more in the proportion of ½ or more of the entire projected area of silver halide grains when the spectral absorption maximum wavelength is less than 500 nm. Further, when the spectral absorption maximum wavelength of the grain is 500 nm or more, the light absorption strength is preferably 150 or more, more preferably 170 or more, and particularly preferably 200 or more, and when the spectral absorption maximum wavelength is less than 500 nm, the light absorption strength is preferably 90 or more, more preferably 100 or more, and particularly preferably 120 or more. The upper limit of the light absorption strength is not particularly restricted but is preferably 2,000 or less, more preferably 1,000 or less, and particularly preferably 500 or less.

With respect to the grains having the spectral absorption maximum wavelength of 500 nm or less, the spectral absorption maximum wavelength is preferably 350 nm or more.

As one example of measuring the light absorption strength, a method of using a microspectrophotometer can be exemplified. A microspectrophotometer is an apparatus capable of measuring the absorption spectrum of a minute area, and it is possible to measure the transmission spectrum of one grain with this apparatus. Regarding the measurement of the absorption spectrum of one grain by a microspectral method, Yamashita et al., *The Substances of the Lectures in Annual Meeting in* 1996, Nihon Shashin Gakkai, p. 15 can be referred to. The absorption strength per one grain can be obtained from the absorption spectrum, but since the light which transmits a grain is absorbed at two planes of the upper plane and the lower plane, the light absorption strength per unit area of the grain surface can be obtained as ½ of the absorption strength per one grain obtained by the above method. The coverage of the integration of absorption spectrum is from 5,000 $cm^{-1}$ to 35,000 $cm^{-1}$ by definition of light absorption strength, but in experiment the coverage of the integration may be the coverage including 500 $cm^{-1}$ or so before and behind the region where a sensitizing dye has absorption.

The light absorption strength is a value determined univocally by the oscillator strength and the ad-molecule number per a unit area of a sensitizing dye, hence the light absorption strength can be obtained by conversion from the oscillator strength of a sensitizing dye, the adsorption amount of a dye and the surface area of a grain.

Since the oscillator strength of a sensitizing dye can be obtained experimentally as a value proportional to the absorption area strength (optical density x $cm^{-1}$) of a sensitizing dye solution, the light absorption strength can be obtained according to the following equation with the errors of about 10% with taking the absorption area strength of a sensitizing dye per 1 M as A (optical density x $cm^{-1}$), the adsorption amount of a sensitizing dye as B (mol/mol Ag), and the surface area of a grain as C ($m^2$/mol Ag):

$$0.156 \times A \times B/C$$

The light absorption strength found from the above equation is substantially the same as the value obtained by integrating the light absorption strength measured according to the above definition [Log $(I_0/(I_0-I))$] to wavelength ($cm^{-1}$).

There are various methods of increasing light absorption strength, e.g., a method of making a dye chromophore adsorb onto the surface of a grain in one or more layers, a method of increasing the molecular extinction coefficient of a dye, and a method of lessening the dye occupation area, and any method can be used but a method of making a dye chromophore adsorb onto the surface of a grain in one or more layers is preferred.

The state of a dye chromophore being adsorbed onto the surface of a grain in one or more layers means that a dye restricted to the vicinity of the silver halide grain is present in one or more layers and a dye present in the dispersion medium is not included. "In one or more layers" used herein includes the case where a dye chromophore is linked with a compound such as a dye adsorbed onto the surface of a grain by covalent bonding as in the present invention. In this case, it is necessary that spectral sensitization is generated by a dye not directly adsorbed onto the surface of the grain, hence excitation energy transfer from the dye not directly adsorbed onto the surface of the silver halide grain to the dye directly adsorbed onto the grain is necessary for that purpose. Accordingly, when excitation energy transfer requires in excess of 10 stages to occur, the final excitation energy transfer becomes low, which is not preferred. The case in which almost all the dye chromophores are present in a dispersion medium and excitation energy transfer requires 10 stages or more such as the polymer dye in JP-A-2-113239 can be exemplified as such an example. The layer number of adsorption of a dye chromophore onto a silver halide grain is preferably 1.5 layers or more, more preferably 1.7 layers or more, and particularly preferably 2 layers.

In the present invention, when the saturated adsorption amount per a unit area attained by a dye having the smallest dye occupation area of the silver halide grain surface among the sensitizing dyes added to the emulsion is taken as one layer saturation covering amount, the state in which more than one layer of the chromophore is adsorbed onto the surface of a silver halide grain means the state in which the adsorption amount of the chromophore per a unit area is more than the one layer saturation covering amount. The layer number of adsorption means the adsorption amount with the one layer saturation covering amount as the standard. In the case of a dye comprising dye chromophores linked by covalent bonding, the dye occupation area of each dye in the state of not being linked can be made standard.

The dye occupation area can be obtained from the adsorption isothermal line showing the relationship between a free dye concentration and an adsorption dye amount and the surface area of a grain. The adsorption isothermal line can be found by referring to, e.g., A. Herz et al., *Adsorption from Aqueous Solution* in Advances in Chemistry Series, No. 17, p. 173 (1968), for instance.

The amount of a sensitizing dye adsorbed onto emulsion grains can be obtained from a method comprising the steps of centrifuging the emulsion onto which a dye is adsorbed, separating the emulsion into emulsion grains and a supernatant gelatin solution, obtaining the non-adsorbed dye concentration by spectral absorption determination of the supernatant and subtracting the thus-obtained non-adsorbed dye concentration from the addition amount of the dye to thereby obtain the adsorbed amount of the dye, and from a method of drying the precipitated emulsion grains, dissolving a specific weight of the precipitate in a 1/1 mixed solution of an aqueous sodium thiosulfate solution and methanol, and obtaining the adsorbed amount of the dye by spectral absorption determination. When a plurality of sensitizing dyes are used, the adsorption amount of each dye can be found, for example, by high speed liquid chromatography.

The dye occupation area can be obtained experimentally, but as the molecular occupation area of generally used sensitizing dyes is about 80 $Å^2$, adsorption layer number can also be estimated roughly with taking the dye occupation area of all the dyes as 80 $Å^2$ for convenience' sake.

In a silver halide photographic emulsion containing the compound of the present invention as a sensitizing dye, the distance between the shortest wavelength and the longest wavelength respectively showing 50% of the maximum value of spectral absorption rate Amax and the maximum value of spectral sensitivity Smax is preferably 120 nm or less, more preferably 100 nm or less.

The distance between the shortest wavelength and the longest wavelength respectively showing 80% of Amax and Smax is 20 nm or more, preferably 100 nm or less, more preferably 80 nm or less, and most preferably 50 nm or less.

The distance between the shortest wavelength and the longest wavelength respectively showing 20% of Amax and Smax is preferably 180 nm or less, more preferably 150 nm or less, particularly preferably 120 nm or less, and most preferably 100 nm or less.

The longest wavelength showing spectral absorption rate of 50% of Amax or Smax is preferably from 460 nm to 510 nm, or from 560 nm to 610 nm, or from 640 nm to 730 nm.

When dye chromophores are multilayer-adsorbed onto silver halide grains in the present invention, the reduction potentials and oxidation potentials of the dye chromophore of the so-called first layer and the dye chromophores of on and after the second layers are not particularly restricted, but it is preferred that the value of the reduction potential of the dye chromophore of the first layer is more positive than the value obtained by subtracting 0.2 v from the value of the reduction potential of the dye chromophores of on and after the second layers in view of the acceleration of electron transfer from the dyes of on and after the second layers to the dye of the first layer and the prevention of the reverse electron transfer. It is preferred that the value of the reduction potential of the dye chromophore of the first layer is more positive than the value of the reduction potential of the dye chromophores of on and after the second layers.

Reduction potential and oxidation potential can be measured by various methods but a measuring method by phase discriminating second harmonic AC polarography is preferred, by which a correct value can be obtained. The measuring method of potential according to phase discriminating second harmonic AC polarography is described in *Journal of Imaging Science,* Vol. 30, p. 27 (1986).

Further, dye chromophores of on and after the second layers are preferably luminescent dyes. As the kinds of luminescent dyes, those having skeletons (i.e., basic structures) of dyes which are used for dye laser are preferred. Such luminescent dyes are described, for example, in Mitsuo Maeda, *Laser Kenkyu* (*The Study of Lasers*), Vol. 8, pp. 694, 803 and 958 (1980), ibid., Vol.9, p.85 (1981), and F. Sehaefer, *Dye Lasers,* Springer (1973).

It is preferred that the absorption maximum wavelength of the dye chromophore of the first layer in a silver halide photographic material is longer than the absorption maximum wavelengths of the dye chromophores of on and after the second layers, further, it is preferred that the light emission of the dye chromophores of on and after the second layers overlap the absorption of the dye chromophore of the first layer, in view of the energy transfer efficiency of from the dyes of on and after the second layers to the dye of the first layer. It is preferred for the dye chromophore of the first layer to form J-association. Moreover, for silver halide grains to have absorption and spectral sensitivity in a desired wavelength region, it is also preferred for the dye chromophores of on and after the second layers to form J-association.

The energy transfer efficiency of from excitation energy of the dyes of on and after the second layers to the dye of the first layer is preferably 30% or more, more preferably 60% or more, and particularly preferably 90% or more. The excitation energy of the dyes of on and after the second layers means the energy of the dye in the state of excitation generated from the dyes of on and after the second layers by absorbing light energy. It is thought that when the excitation energy of a certain molecule is transferred to other molecule, the excitation energy is transferred by way of excitation electron transfer mechanism, Forster Model energy transfer mechanism and Dextor Model energy transfer mechanism, hence it is preferred to satisfy conditions for causing effective excitation energy transfer resulting from these mechanisms. Further, it is especially preferred to satisfy conditions for causing Forster Model energy transfer mechanism.

The energy transfer efficiency of from the dyes of on and after the second layers to the dye of the first layer can be obtained as [the spectral sensitization efficiency when the dyes of on and after the second layers is excited/the spectral sensitization efficiency when the dye of the first layer is excited].

The meanings of the terminologies for use in the present invention are described below.

Dye occupation area: The occupation area per a molecule of a dye. The dye occupation area can be obtained experimentally from the adsorption isothermal line. In the case of a dye comprising dye chromophores linked by covalent bonding, the dye occupation area of each dye in the state of not being linked is made standard. It is regarded as 80 $Å^2$ for convenience sake.

One layer saturation covering amount: The adsorption amount of a dye per a unit surface area of a silver halide grain at one layer saturation covering, which is a reciprocal of the occupation area attained by a dye having the smallest dye occupation area among the sensitizing dyes added to the emulsion.

Multilayer adsorption: The state in which the adsorption amount of a dye chromophore per a unit surface area of a grain is more than the one layer saturation covering amount. In the present invention, since multilayer adsorption means the state in which the adsorption amount of a dye chromophore per a unit surface area of a grain is more than the one layer saturation covering amount, when two dye chromophores are linked by covalent bonding as the dye of one layer adsorption, which means two layer adsorption.

Adsorption layer number: The adsorption layer number means the adsorption amount of a dye chromophore per a unit surface area of a grain when the one layer saturation covering amount is taken as the standard. In the case of a compound comprising two dye chromophores linked by covalent bonding, the adsorption layer number is defined as the above adsorption amount×2. For example, when a dye comprising two dye chromophores linked by covalent bonding has, for example, the same dye occupation area and the same adsorption amount with a non-linked dye, adsorption layer number is two.

EXAMPLE

The present invention will be described in detail below with reference to specific examples, but it should not be construed as being limited thereto.

Example I-1

Synthesis Example of Compound D-45 of the Present Invention

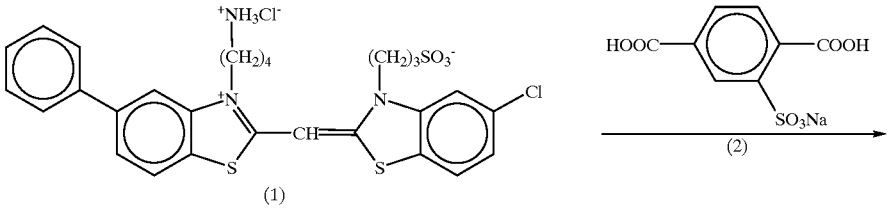

-continued

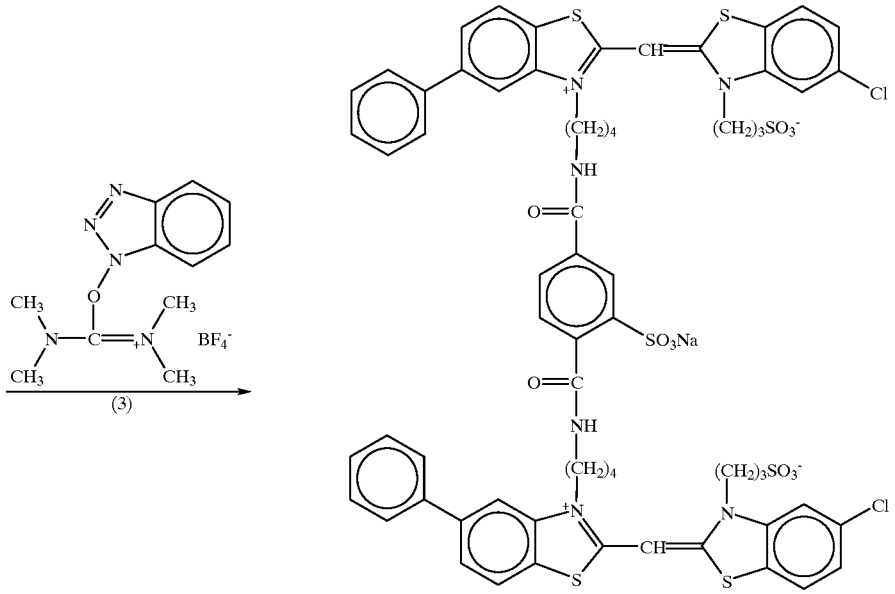

Zero point six eight (0.68) grams (1.1 mmol) of [1] synthesized according to the method disclosed in EP-A-887700, 0.0134 g (0.5 mmol) of dicarboxylic acid [2], and 0.16 g (1.2 mmol) of 1-hydroxybenzotriazole were dissolved in 40 ml of dimethyl sulfoxide, and stirred at 60° C. for 10 minutes. Thereto were added 0.42 g (1.3 mmol) of a uronium salt [3] and 0.51 g (3.9 mmol) of diisopropylethylamine, and the mixture was stirred at 60° C. for 3 hours. After cooling the reaction solution, 400 ml of acetone was added thereto, the crystals precipitated were filtered and vacuum dried. Thus, 0.32 g (yield: 46%) of Compound D-45 was obtained as yellow crystals.

The structure was confirmed by NMR spectrum, MS spectrum and elemental analysis.

Other compounds according to the present invention can also be synthesized according to a similar method.

Example I-2

Preparation of Seed Emulsion a

An aqueous solution (1,164 ml) containing 0.017 g of KBr and 0.4 g of oxidation-processed gelatin having an average molecular weight of 20,000 was stirred with maintaining the temperature at 35° C. An aqueous solution containing 1.6 g of $AgNO_3$, an aqueous solution of KBr and an aqueous solution containing 2.1 g of oxidation-processed gelatin having an average molecular weight of 20,000 was added to the above solution by a triple jet method over 48 seconds. At this time, the silver potential was maintained at 13 mV to the saturated calomel electrode. An aqueous solution of KBr was added thereto, and the silver potential was adjusted to −66 mV, and the temperature was raised to 60° C. After 21 g of succinated gelatin having an average molecular weight of 100,000 was added to the above solution, an aqueous solution containing 5.1 g of NaCl was added. An aqueous solution containing 206.3 g of $AgNO_3$ and an aqueous solution containing KBr were added thereto by a double jet method over 61 minutes with accelerating the flow rate. At this time, the silver potential was maintained at −44 mV to the saturated calomel electrode. After desalting, succinated gelatin having an average molecular weight of 100,000 was added thereto to adjust pH to 5.8 and pAg to 8.8 at 40° C., thus a seed emulsion was obtained. The seed emulsion was tabular grain emulsion containing 1 mol of Ag and 80 g of gelatin per kg of the emulsion, and having an average equivalent-circle diameter of 1.46 μm, an equivalent-circle variation coefficient of 28%, an average thickness of 0.046 μm, and an average aspect ratio of 32.

Formation of Core

An aqueous solution (1,200 ml) containing 134 g of the above-prepared Seed Emulsion a, 1.9 g of KBr and 22 g of succinated gelatin having an average molecular weight of 100,000 was stirred with maintaining the temperature at 75° C. An aqueous solution containing 43.9 g of $AgNO_3$, an aqueous solution containing KBr, and an aqueous solution containing gelatin having a molecular weight of 20,000 were mixed just before addition in another chamber equipped with a magnetic coupling induction stirrer disclosed in JP-A-10-43570, and added to the above emulsion over 25 minutes. At this time, the silver potential was maintained at −40 mV to the saturated calomel electrode.

Formation of First Shell

After the formation of the above core grains, an aqueous solution containing 43.9 g of $AgNO_3$, an aqueous solution containing KBr, and an aqueous solution containing gelatin having a molecular weight of 20,000 were mixed just before addition in the same another chamber, and added to the above emulsion over 20 minutes. At this time, the silver potential was maintained at −40 mV to the saturated calomel electrode.

Formation of Second Shell

After the formation of the above first shell, an aqueous solution containing 42.6 g of $AgNO_3$, an aqueous solution containing KBr, and an aqueous solution containing gelatin having a molecular weight of 20,000 were mixed just before addition in the same another chamber, and added to the above emulsion over 17 minutes. At this time, the silver potential was maintained at −20 mV to the saturated calomel electrode, and then the temperature was lowered to 55° C.

Formation of Third Shell

After the formation of the above second shell, the silver potential was adjusted to −55 mV, and an aqueous solution containing 7.1 g of $AgNO_3$, an aqueous solution containing 6.9 g of KI, and an aqueous solution containing gelatin having a molecular weight of 20,000 were mixed just before addition in the same another chamber, and added to the above emulsion over 5 minutes.

Formation of Fourth Shell

After the formation of the above third shell, an aqueous solution containing 66.4 g of $AgNO_3$ and an aqueous solution containing KBr were added to the above emulsion by a double jet method over 30 minutes at constant flow rate. Potassium iridium hexachloride and yellow prussiate of potash were added en route. At this time, the silver potential was maintained at 30 mV to the saturated calomel electrode. The emulsion was subjected to ordinary washing, and then gelatin was added to adjust pH to 5.8 and pAg to 8.8 at 40° C. The thus-obtained emulsion was designated Emulsion b. Emulsion b was a tabular grain emulsion having an average equivalent-circle diameter of 3.3 μm, an equivalent-circle variation coefficient of 21%, an average thickness of 0.090 μm and an average aspect ratio of 37. Tabular grains having an equivalent-circle diameter of 3.3 μm or more and a thickness of 0.090 μm or less accounted for 70% or more of the entire projected area of Emulsion b.

One layer saturation covering amount of Emulsion b was $1.45\times10^{-3}$ mol/mol Ag with the dye occupation area as 80 Å$^2$.

Emulsion b was heated at 56° C., and after comparative dye S-1 having the structure shown below was added in an amount of $1.2\times10^{-3}$ mol/mol Ag, C-5, potassium thiocyanate, chloroauric acid, sodium thiosulfate and N,N-dimethylselenourea were added and the emulsion was optimally chemically sensitized. Further, S-1 was added in an amount of $2.5\times10^{-4}$ mol/mol Ag, and the emulsion was stirred for 60 minutes, thereby an emulsion for Comparative Example 1 was obtained.

(2) Measurement of the Light Absorption Strength and Adsorption Amount of Dye

The measurement of the light absorption strength per unit area was performed as follows: that is, the obtained emulsion was coated thinly on a slide glass and transmission spectrum and reflection spectrum of each grain were measured using a microspectrophotometer MSP 65 produced by Carl Zeiss Co., Ltd. according to the following method, from which absorption spectrum was searched for. A portion where grains were not present was taken as a reference of transmission spectrum and silicon carbide the reflectance of which was known was measured and the obtained value was made a reference of reflection spectrum. The measurement part was a circular aperture of a diameter of 1 μm, and transmission spectrum and reflection spectrum were measured in the wave number region of from 14,000 $cm^{-1}$ (714 nm) to 28,000 $cm^{-1}$ (357 nm) by adjusting the position so that the aperture part was not overlapped with the contour of the grain. Absorption spectrum was found taking 1−T (transmittance)−R (reflectance) as absorption factor A, one from which the absorption by silver halide was deducted was taken as absorption A'. The value obtained by integrating−Log (1−A') to wave number ($cm^{-1}$) was divided by 2 and this value was taken as the light absorption strength per unit surface area. The integrated region was from 14,000 $cm^{-1}$ to 28,000 $cm^{-1}$. A tungsten lamp was used as the light source and the light source voltage was 8 V. For minimizing the injury of a dye by irradiation of light, a primary monochromator was used, the distance of wavelength was 2 nm, and a slit width was 2.5 nm. Absorption spectrum and light absorption strength were obtained with 200 grains.

The dye adsorption amount was obtained as follows: The emulsion obtained was centrifuged at 10,000 rpm for 10 minutes to be precipitated, and the precipitate was freeze-dried, 25 ml of a 25% aqueous sodium thiosulfate solution and methanol was added to 0.05 g of the precipitate to make the volume 50 ml. This solution was analyzed by a high speed liquid chromatography and dye concentration was determined.

And then, the adsorption layer number of the dye was obtained from the dye adsorption amount and the one layer saturation covering amount.

(3) Preparation of Coated Sample

On a triacetyl cellulose film support having an undercoat layer, the emulsion layer and the protective layer as shown in Table I-1 were coated. Further, comparative compound S-1 was replaced with the compound of the present invention and the like in an equimolar amount and Sample Nos. 101 to 123 were prepared.

TABLE I-1

(1) Emulsion Layer

Emulsion: Emulsion b (used dyes are shown in Table I-2)

Coupler ($1.4 \times 10^{-3}$ mol/m$^2$)

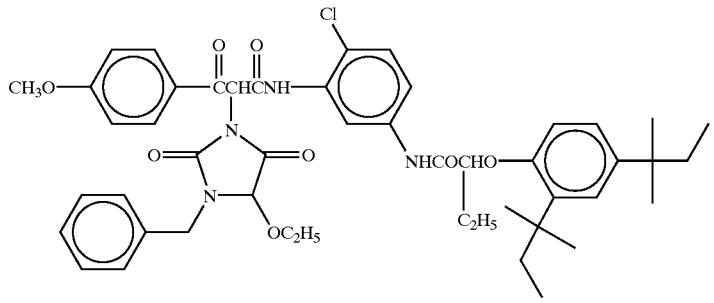

TABLE I-1-continued

| | | |
|---|---|---|
| | Tricresyl Phosphate | (1.10 g/m$^2$) |
| | Gelatin | (2.30 g/m$^2$) |
| (2) | Protective Layer | |
| | Sodium 2,4-Dichloro-6-hydroxy-s-triazine | (0.08 g/m$^2$) |
| | Gelatin | (1.80 g/m$^2$) |

Each sample was subjected to sensitometric exposure for 1/100 sec. and to the following development process.

Processing Step

| Processing Step | Processing Time | Temperature (° C.) | Replenishment Rate* (ml) | Tank Capacity (liter) |
|---|---|---|---|---|
| Color Development | 2 min 45 sec | 38 | 33 | 20 |
| Bleaching | 6 min 30 sec | 38 | 25 | 40 |
| Washing | 2 min 10 sec | 24 | 1,200 | 20 |
| Fixing | 4 min 20 sec | 38 | 25 | 30 |
| Washing (1) | 1 min 05 sec | 24 | counter-current system from (2) to (1) | 10 |
| Washing (2) | 1 min 00 sec | 24 | 1,200 | 10 |
| Stabilization | 1 min 05 sec | 38 | 25 | 10 |
| Drying | 4 min 20 sec | 55 | | |

Replenishment rate: per 1 meter of 35 mm wide

The composition of each processing solution is described below.

Color Developing Solution

| | Mother Solution (g) | Replenisher (g) |
|---|---|---|
| Diethylenetriaminepentaacetic Acid | 1.0 | 1.1 |
| 1-hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N-Ethyl-N-β-hydroxyethylamino)-2-methylaniline Sulfate | 4.5 | 5.5 |
| Water to make | 1.0 l | 1.0 l |
| pH | 10.05 | 10.05 |

Bleaching Solution

| | Mother Solution (g) | Replenisher (g) |
|---|---|---|
| Sodium Ethylenediaminetetraacetato Ferrate Trihydrite | 100.0 | 120.0 |
| Disodium Ethylenediaminetetraacetate | 10.0 | 11.0 |
| Ammonium Bromide | 140.0 | 160.0 |
| Ammonium Nitrate | 30.0 | 35.0 |

-continued

Bleaching Solution

| | Mother Solution (g) | Replenisher (g) |
|---|---|---|
| Aqueous Ammonia (27%) | 6.5 ml | 4.0 ml |
| Water to make | 1.0 l | 1.0 l |
| pH | 6.0 | 5.7 |

Fixing Solutio

| | Mother Solution (g) | Replenisher (g) |
|---|---|---|
| Sodium Ethylenediaminetetraacetate | 0.5 | 0.7 |
| Sodium Sulfite | 7.0 | 8.8 |
| Sodium Bisulfite | 5.0 | 5.5 |
| Aqueous Solution of Ammonium Thiosulfate (70%) | 170.0 ml | 200.0 ml |
| Water to make | 1.0 l | 1.0 l |
| PH | 6.7 | 6.65 |

Stabilizing Solution

| | Mother Solution (g) | Replenisher (g) |
|---|---|---|
| Formalin (37%) | 2.0 ml | 3.0 ml |
| Polyoxyethylene-p-monononylphenyl Ether (polymerization degree: 10) | 0.3 | 0.45 |
| Disodium Ethylenediaminetetraacetate | 0.05 | 0.08 |
| Water to make | 1.0 l | 1.0 l |
| pH | 5.8–8.0 | 5.8–8.0 |

The density of each processed sample was measured through a blue filter and sensitivity and fog were evaluated.

The reciprocal of the exposure amount giving density of fog density+0.2 is taken as sensitivity, and sensitivity of each sample is shown as a relative value taking the value of Sample No. 101 as 100. The emulsion used in each sample and the light absorption strength and sensitivity of each of the comparative compounds and the compounds according to the present invention are shown in Table I-2 below. The light absorption strength is the average value of 200 grains obtained by means of a microspectrophotometer. Light absorption strength and sensitivity of each sample are shown with the value of comparative Sample No. 101 as the control. Light absorption strength of comparative Sample No. 101 was 58.

TABLE I-2

| Sample No. | Compound | Light Absorption Strength | Sensitivity | Remarks |
|---|---|---|---|---|
| 101 | S-1 | 1 (control) | 100 (control) | Comparison |
| 102 | D-1 | 1.90 | 170 | Invention |
| 103 | D-4 | 1.80 | 165 | Invention |
| 104 | D-5 | 1.73 | 159 | Invention |
| 105 | D-6 | 1.78 | 167 | Invention |
| 106 | D-7 | 1.85 | 169 | Invention |
| 107 | D-8 | 1.75 | 165 | Invention |
| 108 | D-20 | 1.80 | 162 | Invention |
| 109 | D-21 | 1.88 | 168 | Invention |
| 110 | D-22 | 1.86 | 166 | Invention |
| 111 | D-23 | 1.79 | 162 | Invention |
| 112 | D-25 | 1.82 | 162 | Invention |
| 113 | D-30 | 1.77 | 162 | Invention |
| 114 | D-32 | 1.76 | 161 | Invention |
| 115 | D-34 | 1.75 | 160 | Invention |
| 116 | S-35 | 1.75 | 160 | Invention |
| 117 | D-36 | 1.73 | 157 | Invention |
| 118 | D-37 | 1.72 | 156 | Invention |
| 119 | D-41 | 1.70 | 154 | Invention |
| 120 | D-45 | 1.85 | 168 | Invention |
| 121 | D-46 | 1.83 | 166 | Invention |
| 122 | D-47 | 1.80 | 166 | Invention |
| 123 | S-2 | 1.26 | 114 | Comparison |

S-1

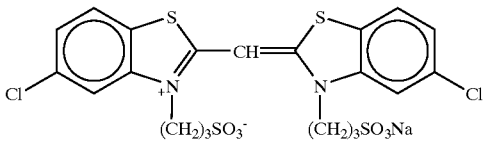

S-2

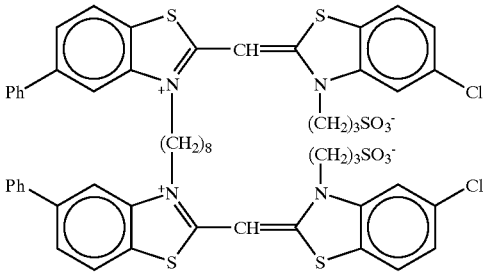

C-5

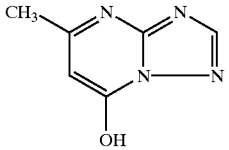

From the results shown in Table I-2, it can be understood that the samples of the present invention are improved in light absorptivity due to multilayer structure, as a result sensitivity is increased as compared with the comparative samples. On the other hand, it is also apparent that linked dye S-2 comprised of a mere alkylene linking group causes plane adsorption and cannot take preferred multilayer structure, therefore, inferior to the samples of the present invention in both light absorption strength and sensitivity.

Further, in Sample No. 102 in which compound D-1 of the present invention is used, adsorption layer number is 1.95, which is almost two-layer structure. Further, distance of 50% of Amax is 50 nm, which is comparatively narrow and preferred and the dye of the first layer and the dyes of on and after the second layers form J-association.

From the above results, it is apparent that when the dyes of on and after the second layers are excited by light, energy transfer or electron transfer from the dyes of on and after the second layers to the dye of the first layer contributes to higher sensitization.

Example I-3

The similar comparison to Example I-2 was performed with the color negative photographic material system disclosed in Example 5 in JP-A-8-29904. When the sensitivity of the blue-sensitive layer of the photographic material using comparative compound S-1 was taken as 100 (control), the sensitivity of the sample using compound D-1 of the present invention was 168. The same comparison was carried out using the instant photographic material system disclosed in Example 1 of JP-A-2000-284442. When the sensitivity of the blue-sensitive layer of the photographic material using comparative compound S-1 was taken as 100 (control), the sensitivity of the sample using compound D-1 of the present invention was as high as 166. Further, from the similar comparisons using the color reversal photographic material systems disclosed in JP-A-7-92601 and Example 1 in JP-A-11-160828, the color paper system in Example 1 in JP-A-6-347944, the X-ray film system in Example 1 in JP-A-8-122954, the photothermographic material system in Example 1 in Japanese Patent Application No. 2000-89436, and the printing material system in Example 1 in JP-A-8-292512, it was found that the photographic materials using the compounds according to the present invention were proved to be higher sensitivity than the comparative samples. Moreover, any of these systems showed high light absorption strength and large adsorption layer number of chromophores, thus it was found that they were effective similarly.

By using the methine dye linked compound according to the present invention, multilayer structure is formed, as a result, light absorptivity is improved and a high sensitivity silver halide photographic material can be obtained.

Example II-1

Synthesis Example of Compound D'-8 of the Present Invention

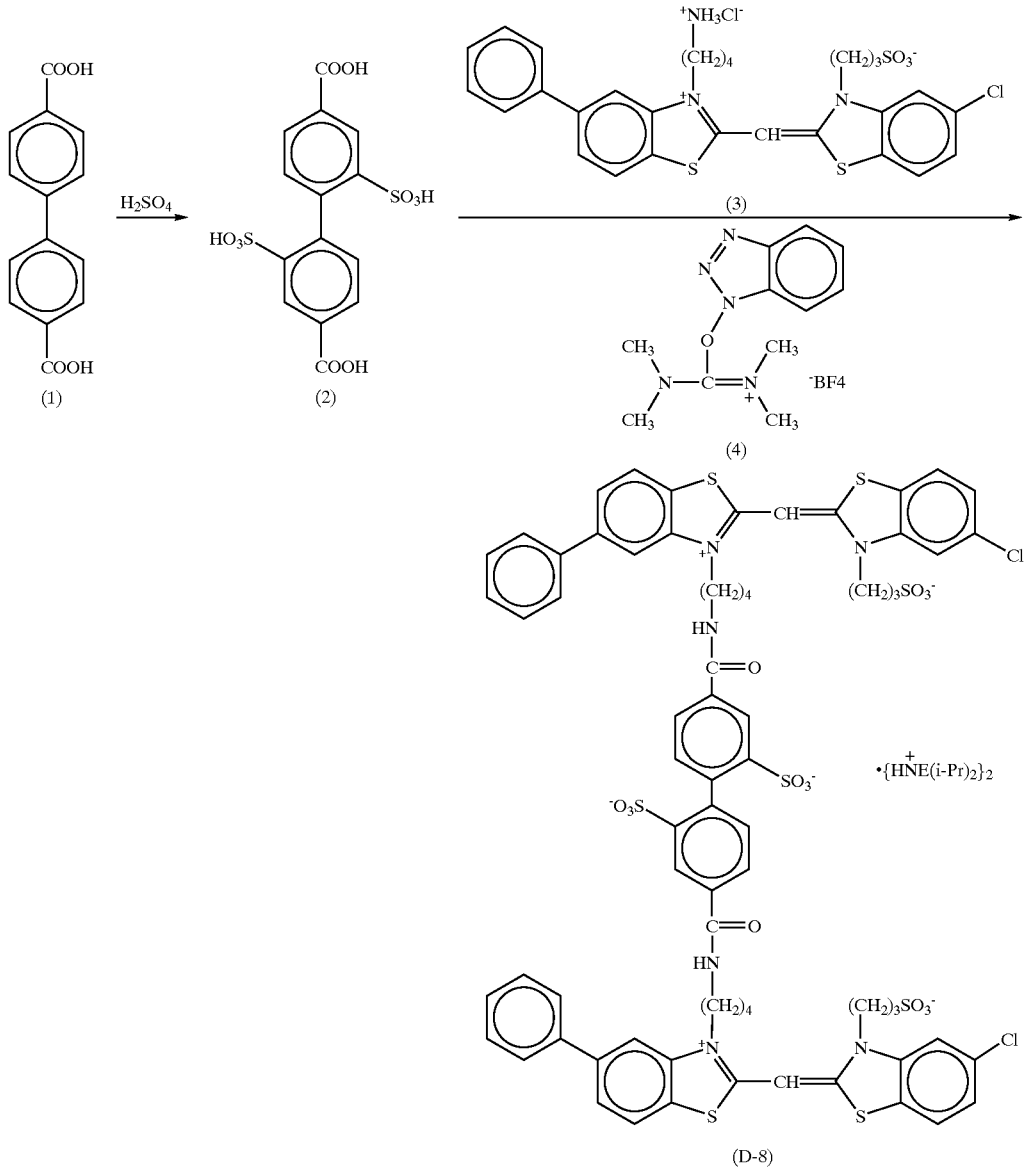

Two point four two (2.42) grams (10 mmol) of 4,4'-biphenyl dicarboxylic acid [1] was dissolved in 10 ml of sulfuric acid and stirred at 200° C. for 8 hours. After cooling, the solution was poured into 100 g of ice water, the crystals precipitated were filtered and dried, thereby 0.96 g (yield: 24%) of [2] was obtained as white crystals.

Zero point eight two (0.82) grams (1.32 mmol) of [3] synthesized according to the method disclosed in EP-A-887700, 0.24 g (0.6 mmol) of [2] and 0.20 g (1.45 mmol) of 1-hydroxybenzotriazole were dissolved in 40 ml of dimethyl sulfoxide, and stirred at 60° C. for 10 minutes. Thereto were added 0.51 g (1.6 mmol) of a uronium salt [4], and 0.63 g (4.8 mmol) of diisopropylethylamine, and the mixture was stirred at 60° C. for 3 hours. After cooling the reaction solution, 400 ml of acetone was added thereto, the crystals precipitated were filtered and vacuum dried. Thus, 0.82 g (yield: 57%) of Compound D'-8 was obtained as yellow crystals.

The structure was confirmed by NMR spectrum, MS spectrum and elemental analysis.

Other compounds according to the present invention can also be synthesized according to a similar method.

Example II-2

Preparation of Seed Emulsion a

An aqueous solution (1,164 ml) containing 0.017 g of KBr and 0.4 g of oxidation-processed gelatin having an average molecular weight of 20,000 was stirred with maintaining the temperature at 35° C. An aqueous solution containing 1.6 g of $AgNO_3$, an aqueous solution of KBr and an aqueous solution containing 2.1 g of oxidation-processed gelatin having an average molecular weight of 20,000 was added to the above solution by a triple jet method over 48 seconds. At this time, the silver potential was maintained at 13 mV to the saturated calomel electrode. An aqueous solution of KBr was added thereto, and the silver potential was adjusted to −66 mV, and the temperature was raised to 60° C. After 21 g of succinated gelatin having an average molecular weight of 100,000 was added to the above solution, an aqueous solution containing 5.1 g of NaCl was added. An aqueous solution containing 206.3 g of $AgNO_3$ and an aqueous solution containing KBr were added thereto by a double jet method over 61 minutes with accelerating the flow rate. At this time, the silver potential was maintained at −44 mV to the saturated calomel electrode. After desalting, succinated gelatin having an average molecular weight of 100,000 was added thereto to adjust pH to 5.8 and pAg to 8.8 at 40° C., thus a seed emulsion was obtained. The seed emulsion was tabular grain emulsion containing 1 mol of Ag and 80 g of gelatin per kg of the emulsion, and having an average equivalent-circle diameter of 1.46 μm, an equivalent-circle variation coefficient of 28%, an average thickness of 0.046 μm, and an average aspect ratio of 32.

Formation of Core

An aqueous solution (1,200 ml) containing 134 g of the above-prepared Seed Emulsion a, 1.9 g of KBr and 22 g of succinated gelatin having an average molecular weight of 100,000 was stirred with maintaining the temperature at 75° C. An aqueous solution containing 43.9 g of $AgNO_3$, an aqueous solution containing KBr, and an aqueous solution containing gelatin having a molecular weight of 20,000 were mixed just before addition in another chamber equipped with a magnetic coupling induction stirrer disclosed in JP-A-10-43570, and added to the above emulsion over 25 minutes. At this time, the silver potential was maintained at −40 mV to the saturated calomel electrode.

Formation of First Shell

After the formation of the above core grains, an aqueous solution containing 43.9 g of $AgNO_3$, an aqueous solution containing KBr, and an aqueous solution containing gelatin having a molecular weight of 20,000 were mixed just before addition in the same another chamber, and added to the above emulsion over 20 minutes. At this time, the silver potential was maintained at −40 mV to the saturated calomel electrode.

Formation of Second Shell

After the formation of the above first shell, an aqueous solution containing 42.6 g of $AgNO_3$, an aqueous solution containing KBr, and an aqueous solution containing gelatin having a molecular weight of 20,000 were mixed just before addition in the same another chamber, and added to the above emulsion over 17 minutes. At this time, the silver potential was maintained at −20 mV to the saturated calomel electrode, and then the temperature was lowered to 55° C.

Formation of Third Shell

After the formation of the above second shell, the silver potential was adjusted to −55 mV, and an aqueous solution containing 7.1 g of $AgNO_3$, an aqueous solution containing 6.9 g of KI, and an aqueous solution containing gelatin having a molecular weight of 20,000 were mixed just before addition in the same another chamber, and added to the above emulsion over 5 minutes.

Formation of Fourth Shell

After the formation of the above third shell, an aqueous solution containing 66.4 g of $AgNO_3$ and an aqueous solution containing KBr were added to the above emulsion by a double jet method over 30 minutes at constant flow rate. Potassium iridium hexachloride and yellow prussiate of potash were added en route. At this time, the silver potential was maintained at 30 mV to the saturated calomel electrode. The emulsion was subjected to ordinary washing, and then gelatin was added to adjust pH to 5.8 and pAg to 8.8 at 40° C. The thus-obtained emulsion was designated Emulsion b. Emulsion b was a tabular grain emulsion having an average equivalent-circle diameter of 3.3 μm, an equivalent-circle variation coefficient of 21%, an average thickness of 0.090 μm and an average aspect ratio of 37. Tabular grains having an equivalent-circle diameter of 3.3 μm or more and a thickness of 0.090 μm or less accounted for 70% or more of the entire projected area of Emulsion b. One layer saturation covering amount of Emulsion b was $1.45\times10^{-3}$ mol/mol Ag with the dye occupation area as 80 $Å^2$.

Emulsion b was heated at 56° C., and after comparative dye S-1 having the structure shown below was added in an amount of $1.2\times10^{-3}$ mol/mol Ag, C-5, potassium thiocyanate, chloroauric acid, sodium thiosulfate and N,N-dimethylselenourea were added and the emulsion was optimally chemically sensitized. Further, S-1 was added in an amount of $2.5\times10^{-4}$ mol/mol Ag, and the emulsion was stirred for 60 minutes, thereby an emulsion containing comparative dye S-1 was obtained.

(2) Measurement of the Light Absorption Strength and Adsorption Amount of Dye

The measurement was performed in the same manner as in Example I-1.

(3) Preparation of Coated Sample

On a triacetyl cellulose film support having an undercoat layer, the emulsion layer and the protective layer as shown in Table I-1 were coated. Further, comparative dye (compound) S-1 was replaced with the compound of the present invention or S-2 in an equimolar amount and Sample Nos. 101 to 116 were prepared.

The density of each processed sample was measured through a blue filter and sensitivity and fog were evaluated.

The reciprocal of the exposure amount giving density of fog density+0.2 is taken as sensitivity, and sensitivity of each sample is shown as a relative value taking the value of Sample No. 101 as 100. The emulsion used in each sample and the light absorption strength and sensitivity of each of the comparative compounds and the compounds according to the present invention are shown in Table II-2 below. The light absorption strength is the average value of 200 grains obtained by means of a microspectrophotometer. Light absorption strength and sensitivity of each sample are shown with the value of comparative Sample No. 101 as the control. Light absorption strength of comparative Sample No. 101 was 58.

TABLE II-2

| Sample No. | Compound | Light Absorption Strength | Sensitivity | Remarks |
|---|---|---|---|---|
| 101 | S-1 | 1 (control) | 100 (control) | Comparison |
| 102 | D'-1 | 1.72 | 152 | Invention |
| 103 | D'-8 | 1.88 | 171 | Invention |
| 104 | D'-9 | 1.83 | 166 | Invention |
| 105 | D'-10 | 1.82 | 168 | Invention |
| 106 | D'-11 | 1.84 | 169 | Invention |
| 107 | D'-12 | 1.80 | 167 | Invention |
| 108 | D'-26 | 1.81 | 163 | Invention |
| 109 | D'-27 | 1.79 | 162 | Invention |

TABLE II-2-continued

| Sample No. | Compound | Light Absorption Strength | Sensitivity | Remarks |
|---|---|---|---|---|
| 110 | D'-29 | 1.81 | 164 | Invention |
| 111 | D'-31 | 1.78 | 161 | Invention |
| 112 | D'-32 | 1.76 | 160 | Invention |
| 113 | D'-36 | 1.79 | 162 | Invention |
| 114 | D'-39 | 1.75 | 157 | Invention |
| 115 | D'-41 | 1.80 | 169 | Invention |
| 116 | S-2 | 1.28 | 116 | Comparison |

S-1

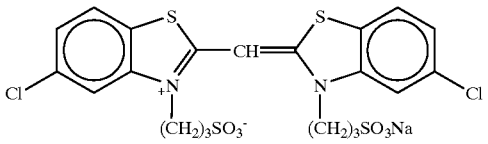

S-2

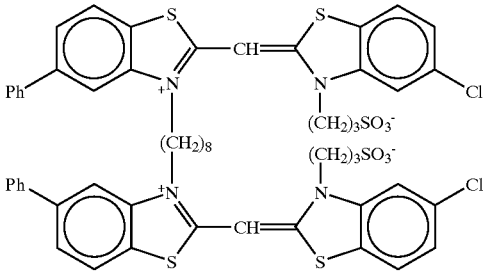

C-5

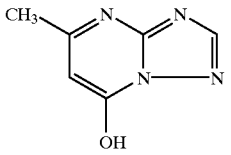

From the results shown in Table II-2, it can be understood that the samples of the present invention are improved in light absorptivity due to multilayer structure, as a result sensitivity is increased as compared with the comparative samples. On the other hand, it is also apparent that linked dye S-2 comprised of a mere alkylene linking group causes plane adsorption and cannot take preferred multilayer structure, therefore, inferior to the samples of the present invention in both light absorption strength and sensitivity.

Further, in Sample No. 103 in which compound D'-8 of the present invention is used, adsorption layer number is 1.95, which is almost two-layer structure. Further, distance of 50% of Amax is 50 nm, which is comparatively narrow and preferred and the dye of the first layer and the dyes of on and after the second layers form J-association.

From the above results, it is apparent that when the dyes of on and after the second layers are excited by light, energy transfer or electron transfer from the dyes of on and after the second layers to the dye of the first layer contributes to higher sensitization.

Example II-3

The similar comparison to Example II-2 was performed with the color negative photographic material system disclosed in Example 5 in JP-A-8-29904. When the sensitivity of the blue-sensitive layer of the photographic material using comparative compound S-1 was taken as 100 (control), the sensitivity of the sample using compound D'-8 of the present invention was 169. The same comparison was carried out using the instant photographic material system disclosed in Example 1 of JP-A-2000-284442. When the sensitivity of the blue-sensitive layer of the photographic material using comparative compound S-1 was taken as 100 (control), the sensitivity of the sample using compound D'-8 of the present invention was as high as 167. Further, from the similar comparisons using the color reversal photographic material systems disclosed in JP-A-7-92601 and Example 1 in JP-A-11-160828, the color paper system in Example 1 in JP-A-6-347944, the X-ray film system in Example 1 in JP-A-8-122954, the photothermographic material system in Example 1 in Japanese Patent Application No. 2000-89436, and the printing material system in Example 1 in JP-A-8-292512, it was found that the photographic materials using the compounds according to the present invention were proved to be higher sensitivity than the comparative samples. Moreover, any of these systems showed high light absorption strength and large adsorption layer number of chromophores, thus it was found that they were effective similarly.

By using the methine dye linked compound according to the present invention, multilayer structure is formed, as a result, light absorptivity is improved and a high sensitivity silver halide photographic material can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, wherein said emulsion layer comprises silver halide grains and a compound represented by the following formula (1):

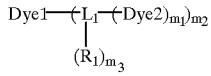

(1)

wherein Dye 1 represents a first chromophore; Dye 2 represents a second chromophore; $L_1$ represents a linking chain; $R_1$ represents a dissociable group having pKa of 5 or less; $m_1$ represents an integer of from 1 to 5; $m_2$ represents an integer of from 1 to 5; and $m_3$ represents an integer of from 1 to 4.

2. The silver halide photographic material as claimed in claim 1, wherein $R_1$ in formula (1) represents —$SO_3M$, —$OSO_3M$, —$PO_3M_2$, —$OPO_3M2$ or —COOM, and M represents a proton or a cation.

3. The silver halide photographic material as claimed in claim 1, wherein $L_1$ in formula (1) is represented by —$G_1$-($A_1$-$G_2$-)$t_1$-; $G_1$ and $G_2$ each represents an alkylene group or an alkenylene group; $A_1$ represents —O—, —S—, —$SO_2$—, —$NR_2$—, —COO—, —$CONR_3$—, —$SO_2NR_4$—, —OOC—, —$NR_3CO$—, or —$NR_4SO_2$—; $R_2$, $R_3$ and $R_4$ each represents a hydrogen atom, an alkyl group, an alkenyl group, an aryl group or a heterocyclic group; $t_1$ represents an integer of from 1 to 10; and $R_1$ may substitute on any of $G_1$, $G_2$, $R_2$, $R_3$ and $R_4$.

4. The silver halide photographic material as claimed in claim 1, wherein Dye 1 and Dye 2 in formula (1) each represents a cyanine chromophore, a merocyanine chromophore or an oxonol chromophore.

5. The silver halide photographic material as claimed in claim 1, wherein Dye 1 and Dye 2 in formula (1) have the same structure.

6. The silver halide photographic material as claimed in claim 1, wherein the compound represented by formula (1) is represented by the following formula (2):

(2)

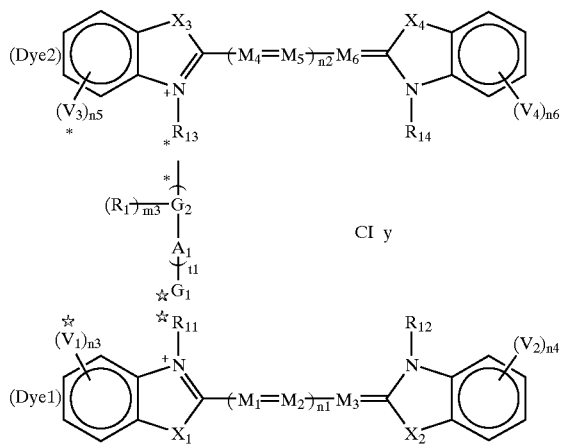

wherein $G_1$ and $G_2$ each represents an alkylene group or an alkenylene group; $A_1$ represents —O—, —S—, —$SO_2$—, —$NR_2$—, —COO—, —$CONR_3$—, —$SO_2NR_4$—, —OOC—, —$NR_3CO$—, or —$NR_4SO_2$—; $t_1$ represents an integer of from 1 to 10; $R_1$ represents —$SO_3M$, —$OSO_3M$, —$PO_3M_2$, —$OPO_3M_2$ or —COOM; M represents a proton or a cation; $m_3$ represents an integer of from 1 to 4; $R_1$ may substitute on any of $G_1$, $G_2$ and $A_1$; $X_1$, $X_2$, $X_3$ and $X_4$ each represents —O—, —S—, —$NR_5$— or —$CR_6R_7$—; $R_5$, $R_6$ and $R_7$ each represents a hydrogen atom, an alkyl group, an alkenyl group, an aryl group or a heterocyclic group; $R_{11}$, $R_{12}$, $R_{13}$ and $R_{14}$ each represents a hydrogen atom, an alkyl group, an alkenyl group, an aryl group or a heterocyclic group; $M_1$, $M_2$, $M_3$, $M_4$, $M_5$ and $M_6$ each represents a methine group; $n_1$ and $n_2$ each represents an integer of from 0 to 3; $V_1$, $V_2$, $V_3$ and $V_4$ each represents a substituent; $n_3$, $n_4$, $n_5$ and $n_6$ each represents an integer of from 0 to 4, when $n_3$, $n_4$, $n_5$ and $n_6$ each represents 2 or more, $V_1$, $V_2$, $V_3$ and $V_4$ may be the same or different, and they may be linked to each other to form a ring; CI represents an ion to neutralize electric charge; and y represents a number necessary to neutralize electric charge.

7. The silver halide photographic material as claimed in claim 1, wherein $L_1$ represents -$G_1$-$G_3$-$G_2$-; $G_1$ and $G_2$ each represents an alkylene group or an alkenylene group; and $G_3$ represents a linking group having two or more groups selected from the group consisting of an arylene group, a heterylene group and a cycloalkylene group in the linking chain.

8. The silver halide photographic material as claimed in claim 7, wherein G3 is represented by -$A_1$-($G_4$-$A_2$-)$t_1$-; $G_4$ represents an arylene group, a heterylene group, a cycloalkylene group or a group containing these groups; $A_1$ and $A_2$ each represents —O—, —S—, —$SO_2$—, —$NR_2$—, —COO—, —$CONR_3$—, —$SO_2NR_4$—, —OOC—, —$NR_3CO$—, or —$NR_4SO_2$—; $R_2$, $R_3$ and $R_4$ each represents a hydrogen atom, an alkyl group, an alkenyl group, an aryl group or a heterocyclic group; and $t_1$ represents an integer of from 1 to 10.

9. The silver halide photographic material as claimed in claim 1, wherein the compound represented by formula (1) is represented by the following formula (3):

(3)

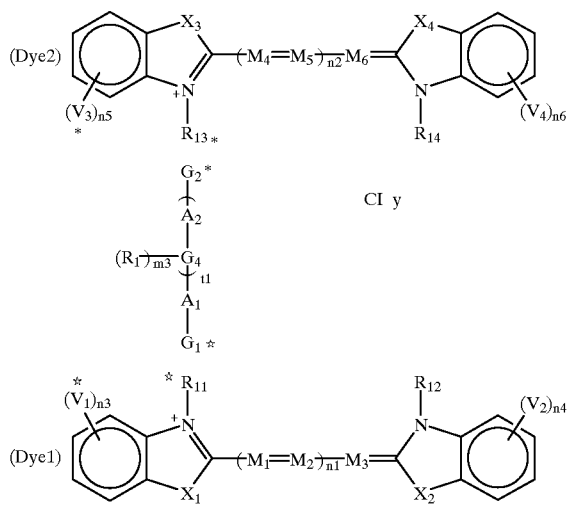

wherein $G_1$ and $G_2$ each represents an alkylene group or an alkenylene group; $G_4$ represents an arylene group, a heterylene group, a cycloalkylene group or a group containing these groups; $A_1$ and $A_2$ each represents —O—, —S—, —$SO_2$—, —$NR_2$—, —COO—, —$CONR_3$—, —$SO_2NRA$—, —OOC—, —$NR_3CO$—, or —$NR_4SO_2$—; $R_2$, $R_3$ and $R_4$ each represents a hydrogen atom, an alkyl group, an alkenyl group, an aryl group or a heterocyclic group; and $t_1$ represents an integer of from 1 to 10; $R_1$ represents —$SO_3M$, —$OSO_3M$, —$PO_3M_2$, —$OPO_3M_2$ or —COOM; M represents a proton or a cation; $m_3$ represents an integer of from 1 to 4; $X_1$, $X_2$, $X_3$ and $X_4$ each represents —O—, —S—, —$NR_5$— or —$CR_6R_7$—; $R_5$, $R_6$ and $R_7$ each represents a hydrogen atom, an alkyl group, an alkenyl group, an aryl group or a heterocyclic group; $R_{11}$, $R_{12}$, $R_{13}$ and $R_{14}$ each represents a hydrogen atom, an alkyl group, an alkenyl group, an aryl group or a heterocyclic group; $M_1$, $M_2$, $M_3$, $M_4$, $M_5$ and $M_6$ each represents a methine group; $n_1$ and $n_2$ each represents an integer of from 0 to 3; $V_1$, $V_2$, $V_3$ and $V_4$ each represents a substituent; $n_3$, $n_4$, $n_5$ and $n_6$ each represents an integer of from 0 to 4, when $n_3$, $n_4$, $n_5$ and $n_6$ each represents 2 or more, $V_1$, $V_2$, $V_3$ and $V_4$ may be the same or different, and they may be linked to each other to form a ring; CI represents an ion to neutralize electric charge; y represents a number necessary to neutralize electric charge; and $G_1$ is linked to Dye 1 via $R_{11}$ or $V_1$, and $G_2$ is linked to Dye 2 via $R_{13}$ or $V_3$.

10. The silver halide photographic material as claimed in claim 1, wherein in the compound represented by formula (1), the adsorptivity of Dye 1, Dye 2, and $L_1$-($R_1$)$m_3$ to a silver halide grain satisfies the following relationship:

$$\text{Dye } 1 \geqq \text{Dye } 2 > L_1\text{-}(R_1)_{m3}.$$

11. The silver halide photographic material as claimed in claim 1, wherein in the compound represented by formula (1), only one chromophore of Dye 1 or Dye 2 is adsorbed onto a silver halide grain, and when the chromophore not adsorbed onto a silver halide grain is excited by light, the chromophore not adsorbed onto a silver halide grain is transferred to the chromophore adsorbed onto a silver halide grain by electron transfer or energy transfer.

12. The silver halide photographic material as claimed in claim 1, wherein said silver halide emulsion is an emulsion in which tabular grains having an aspect ratio of 2 or more account for 50% (area) or more of the entire silver halide grains in the emulsion.

13. The silver halide photographic material as claimed in claim 1, wherein said silver halide emulsion is sensitized by selenium sensitization.

* * * * *